US010283869B2

(12) United States Patent
Sonoda et al.

(10) Patent No.: US 10,283,869 B2
(45) Date of Patent: May 7, 2019

(54) MIMO ANTENNA AND WIRELESS DEVICE

(71) Applicant: AGC Inc., Tokyo (JP)

(72) Inventors: Ryuta Sonoda, Tokyo (JP); Koji Ikawa, Tokyo (JP); Toshiki Sayama, Tokyo (JP)

(73) Assignee: AGC Inc., Tokyo (JP)

( * ) Notice: Subject to any disclaimer, the term of this patent is extended or adjusted under 35 U.S.C. 154(b) by 0 days.

(21) Appl. No.: 14/790,472

(22) Filed: Jul. 2, 2015

(65) Prior Publication Data

US 2015/0303577 A1 Oct. 22, 2015

Related U.S. Application Data

(63) Continuation of application No. PCT/JP2014/050356, filed on Jan. 10, 2014.

(30) Foreign Application Priority Data

Jan. 10, 2013 (JP) ..... 2013-002988

(51) Int. Cl.

| | |
|---|---|
| ***H01Q 9/06*** | (2006.01) |
| ***H01Q 21/00*** | (2006.01) |
| ***H01Q 21/24*** | (2006.01) |
| ***H01Q 21/28*** | (2006.01) |
| ***H01Q 1/12*** | (2006.01) |
| ***H01Q 9/28*** | (2006.01) |

(52) U.S. Cl.

CPC ..... *H01Q 9/065* (2013.01); *H01Q 1/1271* (2013.01); *H01Q 1/1285* (2013.01); *H01Q 9/285* (2013.01); *H01Q 21/00* (2013.01); *H01Q 21/24* (2013.01); *H01Q 21/28* (2013.01)

(58) Field of Classification Search

CPC ..... H01Q 9/065; H01Q 9/285; H01Q 1/1271; H01Q 1/1285; H01Q 21/00; H01Q 21/24; H01Q 21/28

See application file for complete search history.

(56) References Cited

U.S. PATENT DOCUMENTS 7,106,256 B2 9/2006 Watanabe et al.
7,176,837 B2 2/2007 Sonoda et al.
(Continued)

FOREIGN PATENT DOCUMENTS

EP 2 053 692 A2 4/2009
EP 2 053 692 A3 4/2009
(Continued)

OTHER PUBLICATIONS

International Search Report dated Apr. 8, 2014 in PCT/JP2014/050356, filed Jan. 10, 2014.
(Continued)

*Primary Examiner* — Jessica Han
*Assistant Examiner* — Michael M Bouizza
(74) *Attorney, Agent, or Firm* — Oblon, McClelland, Maier & Neustadt L.L.P.

(57) ABSTRACT

A MIMO antenna is provided that includes a ground plane, and a plurality of dipole antenna elements that are arranged in the vicinity of the ground plane. Each of the plurality of dipole antenna elements includes a radiating element including a conductor portion extending along an outer edge portion of the ground plane, and a feeding portion that feeds the radiating element.

20 Claims, 16 Drawing Sheets

(56) References Cited

U.S. PATENT DOCUMENTS

| | | | | |
|---|---|---|---|---|
| 7,365,685 | B2 | 4/2008 | Takeuchi et al. | |
| 2005/0052334 | A1 | 3/2005 | Ogino et al. | |
| 2005/0119035 | A1 | 6/2005 | Miyano et al. | |
| 2007/0046542 | A1 | 3/2007 | Andrenko et al. | |
| 2007/0052599 | A1 | 3/2007 | Shimizu et al. | |
| 2009/0102742 | A1 | 4/2009 | Park et al. | |
| 2011/0115687 | A1 | 5/2011 | Huang | |
| 2011/0133992 | A1 | 6/2011 | Suzuki | |
| 2011/0175792 | A1* | 7/2011 | Yoon | H01Q 21/28 343/893 |
| 2012/0212389 | A1* | 8/2012 | Aizawa | H01Q 21/28 343/893 |
| 2013/0162496 | A1* | 6/2013 | Wakabayashi | H01Q 21/00 343/853 |
| 2015/0130669 | A1 | 5/2015 | Sonoda et al. | |

FOREIGN PATENT DOCUMENTS

| | | | |
|---|---|---|---|
| JP | 2004-147351 | | 5/2004 |
| JP | 2005-057723 | A | 3/2005 |
| JP | 2009-100444 | A | 5/2009 |
| JP | 2010-130115 | A | 6/2010 |
| JP | 2011-120164 | A | 6/2011 |
| WO | WO 2007/043150 | A1 | 4/2007 |
| WO | WO 2009/081803 | A1 | 7/2009 |
| WO | WO 2011/134492 | A1 | 11/2011 |

OTHER PUBLICATIONS

A. Kurs, et al., "Wireless Power Transfer via Strongly Coupled Magnetic Resonances," Science Express, vol. 317, No. 5834, pp. 83-86, Jul. 6, 2007.

* cited by examiner

MIMO ANTENNA AND WIRELESS DEVICE

CROSS-REFERENCE TO RELATED APPLICATION

The present application is a continuation application filed under 35 U.S.C. 111(a) claiming benefit under 35 U.S.C. 120 and 365(c) of PCT International Application No. PCT/JP2014/050356 filed on Jan. 10, 2014 and designating the U.S., which claims priority to Japanese Patent Application No. 2013-002988 filed on Jan. 10, 2013. The entire contents of the foregoing applications are incorporated herein by reference.

BACKGROUND OF THE INVENTION

1. Field of the Invention

The present invention relates to a MIMO (Multiple Input Multiple Output) antenna including a plurality of antenna elements, and a wireless device. 2. Description of the Related Art In the field of communication devices such as mobile terminals where an adequate distance cannot be secured between antenna elements, there is a demand for a MIMO antenna with a high antenna gain and a low correlation coefficient between antenna elements in order to ensure good MIMO effects. The MIMO antenna is a multi-antenna that is capable of multiple-input and multiple-output operations at a predetermined frequency using a plurality of antenna elements. For example, Japanese Laid-Open Patent Publication No. 2010-130115 discloses a MIMO antenna including a plurality of monopole antenna elements that utilize a ground plane as a MIMO antenna including a plurality of antennal elements.

In MIMO antennas, the correlation coefficient between antenna elements has to be lowered. However, in MIMO antennas that use monopole antenna elements, the correlation coefficient cannot be lowered unless the monopole antenna elements are released from the ground plane. When the monopole antenna elements are released from the ground plane, the space required for installing the antenna elements is expanded, and as such, it is difficult to reduce the installation space of the antenna elements and lower the correlation coefficient between the antenna elements at the same time.

SUMMARY OF THE INVENTION

An aspect of the present invention is directed to providing a MIMO antenna and a wireless device that can reduce the installation space of antenna elements and lower the correlation coefficient between the antenna elements at the same time.

According to one embodiment of the present invention, a MIMO antenna is provided that includes a ground plane, and a plurality of dipole antenna elements that are arranged in the vicinity of the ground plane. Each of the plurality of dipole antenna elements includes a radiating element including a conductor portion extending along an outer edge portion of the ground plane, and a feeding portion that feeds the radiating element.

DESCRIPTION OF THE PREFERRED EMBODIMENTS

In the following, embodiments of the present invention will be described with reference to the accompanying drawings.

<Configuration of MIMO Antenna 1>

Figure 1:
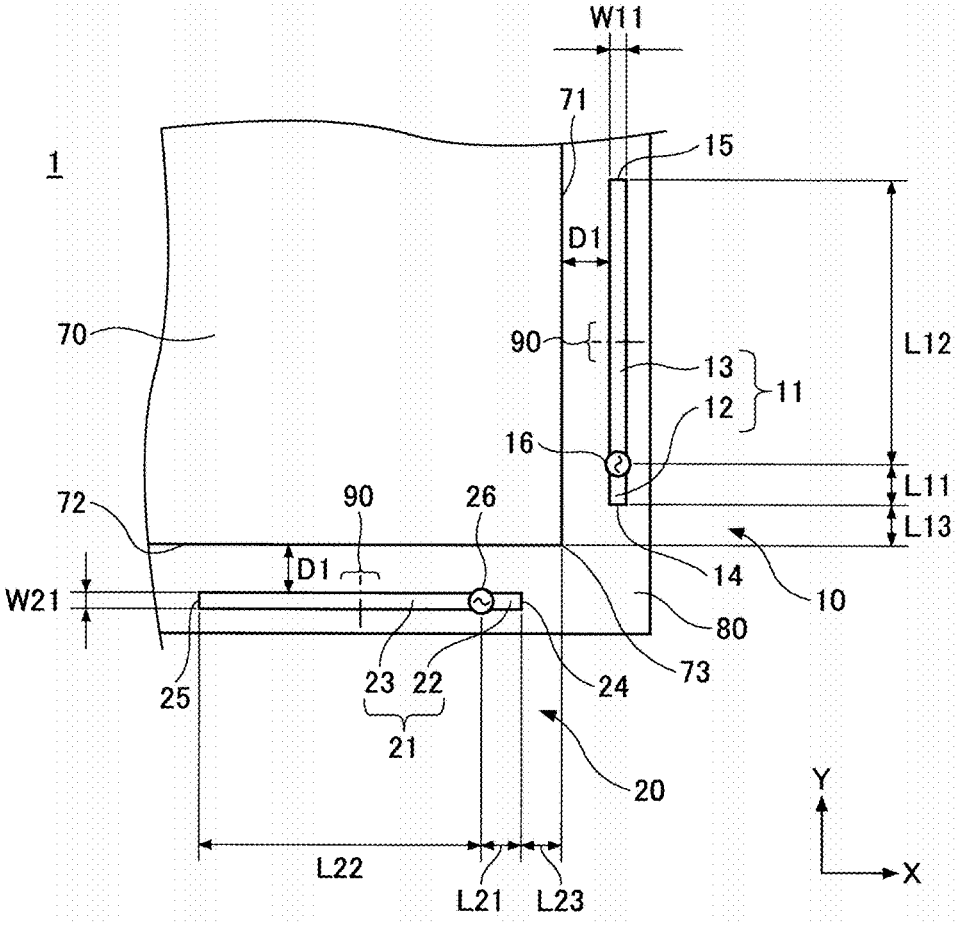
FIG. 1 is a plan view of a MIMO antenna including a plurality of dipole antenna elements having radiating elements that are orthogonal.

FIG. 1 is a plan view of a computer simulation model for analyzing the operation of a MIMO antenna 1 according to an embodiment of the present invention. As an electromagnetic field simulator, Microwave Studio (registered trademark) (manufactured by CST Co., Ltd.) was used. The MIMO antenna 1 is a multi-antenna including a ground plane 70, a dipole antenna element 10, and a dipole antenna element 20.

The ground plane 70 is, for example, a ground region including at least one corner portion 73, an outer edge portion 71 linearly extending from the corner portion 73 in the Y-axis direction, and an outer edge portion 72 linearly extending in the X-axis direction from the corner portion 73. Although the extending direction of the outer edge portion 71 and the extending direction of the outer edge portion 72 are preferably arranged to be orthogonal, the intersecting angle of the extending directions may deviate within a range that would not impair the effects of the present invention. For example, the intersecting angle may preferably be greater than or equal to 70° and less than or equal to 110°, and more preferably greater than or equal to 80° and less than or equal to 100°.

The dipole antenna elements 10 and 20 are arranged in the vicinity of the corner portion 73 of the ground plane 70, for example. The dipole antenna element 10 is arranged along the outer edge portion 71, and may be spaced apart from the outer edge portion 71 by a predetermined distance D1 in the X-axis direction and extend parallel to the outer edge portion 71 in the Y-axis direction, for example. The dipole antenna element 20 is arranged along the outer edge 72, and may be spaced apart from the outer edge portion 72 by the predetermined distance D1 in the Y-axis direction and extend parallel to the outer edge portion 72 in the X-axis direction, for example. In FIG. 1, the predetermined distance D1 between the dipole antenna element 10 and the outer edge portion 71 and the predetermined distance D1 between the dipole antenna element 20 and the outer edge portion 72 are set equal; however, the predetermined distances do not necessarily have to be set equal. Note that in a case where the dipole antenna element 10 is arranged to be spaced apart from the outer edge portion 71 in both the X-axis direction and a thickness direction (Z-axis direction), a shortest distance D2 between the dipole antenna element 10 and the outer edge portion 71 corresponds to the distance of a straight line connecting sections of the dipole antenna element 10 and the outer edge portion 71 that are closest to each other. Similarly, in a case where the dipole antenna element 20 and the outer edge portion 72 are spaced apart in both the Y-axis direction and the thickness direction (Z-axis direction), the shortest distance D2 between the dipole antenna element 20 and the outer edge portion 72 corresponds to the distance of a straight line connecting sections of the dipole antenna element 20 and the outer edge portion 72 that are closest to each other.

Each of the plurality of dipole antenna elements may include a radiating element having a conductor portion extending in a direction perpendicular to the extending direction of the conductor portion of another dipole antenna element of the plurality of dipole antenna elements, for example. The dipole antenna element 10 includes a radiating element 11, and the dipole antenna element 20 includes a radiating element 21. The radiating element 11 is an antenna conductor that functions as an antenna having a feeding portion 16 as a feeding point, and the radiating element 21 is an antenna conductor that functions as an antenna having a feeding portion 26 as a feeding point.

The radiating element 11 of the dipole antenna element 10 includes a conductor portion 12 and a conductor portion 13 that extend in a direction perpendicular to the extending direction of a conductor portion 22 or a conductor portion 23 of the radiating element 21 of the other dipole antenna element 20 that is different from the dipole antenna element 10. The conductor portions 12 and 13 are linear antenna conductor portions that are arranged along the outer edge portion 71, and may be spaced apart from the outer edge portion 71 by the predetermined distance D1 in the X-axis direction and extend parallel to the outer edge portion 71 in the Y-axis direction, for example. By arranging the radiating element 11 to have the conductor portions 12 and 13 along the outer edge portion 71, the directivity of the MIMO antenna 1 may be easily controlled, for example.

The radiating element 21 of the dipole antenna element 20 includes the conductor portion 22 and the conductor portion 23 that extend in a direction perpendicular to the extending direction of the conductor portion 12 or the conductor portion 13 of the radiating element 11 of the other dipole antenna element 10 that is different from the dipole antenna element 20. The conductor portions 22 and 23 are linear antenna conductor portions that are arranged along the outer edge portion 72, and may be spaced apart from the outer edge portion 72 by the predetermined distance D1 in the X-axis direction and extend parallel to the outer edge portion 72 in the Y-axis direction, for example. By arranging the radiating element 21 to have the conductor portions 22 and 23 along the outer edge portion 72, the directivity of the MIMO antenna 1 may be easily controlled, for example.

The radiating elements 11 and 21 may be mounted to a dielectric substrate 80, and may be placed on a surface of the dielectric substrate 80 or installed inside the dielectric substrate 80, for example. The dielectric substrate 80 may be a resin substrate, for example. However, a dielectric material other than resin such as glass, glass ceramic, or LTCC (Low Temperature Co-Fired Ceramics) may be used as well. The ground plane 70 may be a region formed at the dielectric substrate 80 or a region formed at a separate member from the dielectric substrate 80. In the illustrated case, the radiating elements 11 and 21 are arranged at the same surface of the dielectric substrate 80. However, the radiating elements 11 and 21 may be arranged at different layers in the Z-axis direction. Also, the radiating element 11 or the radiating element 21 may be arranged at the same layer in the Z-axis direction as the ground plane 70, or the radiating elements 11 and 21 may be arranged at different layers from the ground plane 70.

The dipole antenna element 10 includes the feeding portion 16 for feeding the radiating element 11. The feeding portion 16 is a feeding point that is inserted into a conductor portion between one end portion 14 and another end portion 15 of the radiating element 11.

In FIG. 1, the feeding portion 16 is positioned at a region between the end portion 14 and the end portion 15 of the radiating element 11 other than a central portion 90 of the radiating element 11 (a region between the central portion 90 and the end portion 14 or the end portion 15). By positioning the feeding portion 16 at a region of the radiating element 11 other than the central portion 90 as described above, matching of the dipole antenna element 10 may be facilitated. For example, to facilitate matching of the dipole antenna element 10, the feeding portion 16 may be located at a region spaced part from the central portion 90 of the radiating element 11 by a distance greater than or equal to ⅛ of the total length of the radiating element 11 (preferably, greater than or equal to ⅙ of the total length, and more preferably greater than or equal to ¼ of the total length). In FIG. 1, the total length of the radiating element 11 is equal to L11+L12, and the feeding portion 16 is positioned away from the central portion 90 toward the corner portion 73 of the ground plane 70.

To facilitate matching of the dipole antenna element 10, the feeding portion 16 may be a feeding point located at a region between the end portion 14 and the end portion 15 having higher impedance than the central portion 90. The impedance of the radiating element 11 becomes higher as the distance away from the central portion 90 and toward the end portion 14 or the end portion 15 of the radiating element 11 increases, and in FIG. 1, the feeding portion 16 is positioned away from the central portion 90 of the radiating element 11 toward the end portion 14.

The dipole antenna element 20 includes a feeding portion 26 for feeding the radiating element 21. The feeding portion 26 is a feeding point that is inserted into a conductor portion between one end portion 24 and another end portion 25 of the radiating element 21.

In FIG. 1, the feeding portion 26 is located at a region between the end portion 24 and the end portion 25 of the radiating element 21 other than a central portion 90 of the radiating element 21 (a region between the central portion 90 and the end portion 24 or the end portion 25). By positioning the feeding portion 26 at a region of the radiating element 21 other than the central portion 90 as described above, matching of the dipole antenna element 20 may be facilitated. For example, to facilitate matching of the dipole antenna element 20, the feeding portion 26 may be located at a region spaced apart from the central portion 90 of the radiating element 21 by a distance greater than or equal to ⅛ of the total length of the radiating element 21 (preferably, greater than or equal to ⅙ of the total length, and more preferably greater than or equal to ¼ of the total length). In FIG. 1, the total length of the radiating element 21 is equal to L21+L22, and the feeding portion 26 is positioned away from the central portion 90 toward the corner portion 73 of the ground plane 70.

To facilitate matching of the dipole antenna element 20, the feeding portion 26 may be a feeding point located at a region between the end portion 24 and the end portion 25 having higher impedance than the central portion 90. The impedance of the radiating element 21 becomes higher as the distance away from the central portion 90 and toward the end portion 24 or the end portion 25 of the radiating element 21 increases, and in FIG. 1, the feeding portion 26 is positioned toward the end portion 24 with respect to the central portion 90 of the radiating element 21.

The feeding portion 16 and the feeding portion 26 are located at regions that are shifted from the central portions 90 of the radiating elements 11 and 21 in directions approaching each other. In this way, matching of the dipole antenna elements 10 and 20 may be facilitated, and transmission lines respectively connected to the feeding portions 16 and 26 may be brought closer to each other such that the space required for installing the dipole antenna elements 10 and 20 may be easily reduced.

As a method for feeding the feeding portion 16 and the feeding portion 26, for example, unbalanced lines such as coaxial cables may be directly connected to the radiating elements 11 and 21, or the lines may be converted into balanced lines via baluns and directly connected to the radiating elements 11 and 21, for example. Also, in a case where the radiating elements 11 and 21 are formed on a dielectric substrate having a ground plane, they may be connected by planar transmission lines, for example. Further, metal pins from another dielectric substrate that is different from the dielectric substrate at which the radiating elements 11 and 21 are formed may be connected to the conductor portions of the radiating elements 11 and 21, for example. In this way, a suitable method for feeding the dipole antenna elements 10 and 20 may be selected according to the implementation environment.

<Configuration of MIMO Antenna 2>

Figure 2:
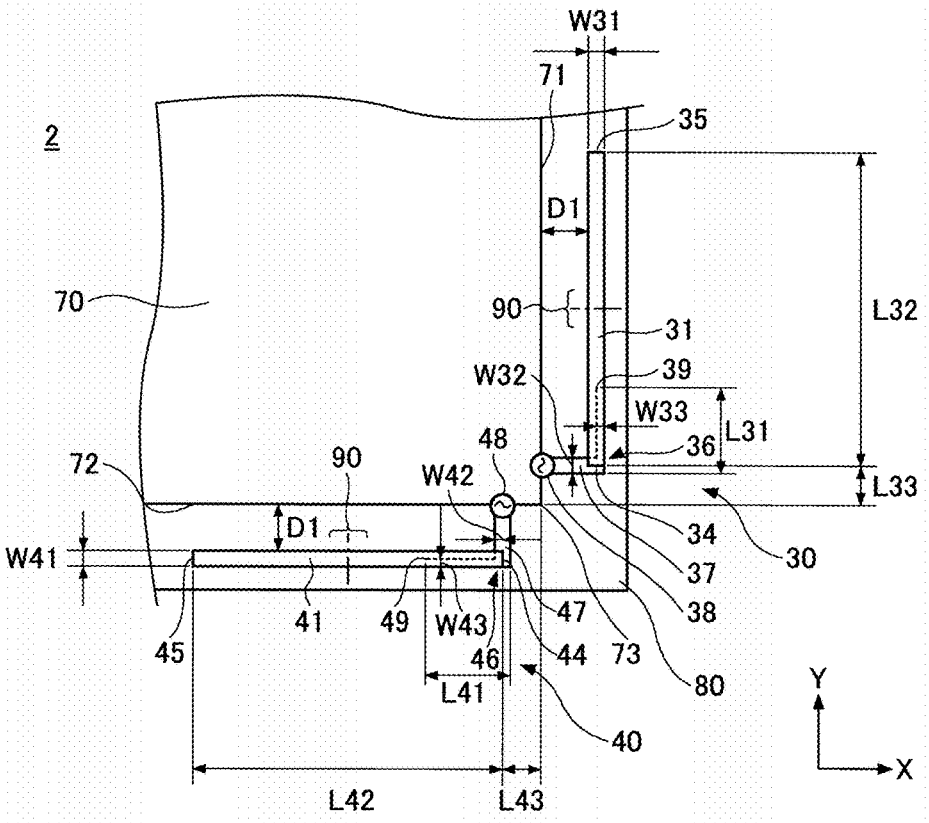
FIG. 2 is a plan view of a MIMO antenna including a plurality of non-contact feeding dipole antenna elements having radiating elements that are orthogonal.

FIG. 2 is a plan view showing a computer simulation model for analyzing the operation of a MIMO antenna 2 according to another embodiment of the present invention. As the electromagnetic field simulator, the Microwave Studio (registered trademark) (manufactured by CST Co., Ltd.) was used. Note that descriptions of features of the present embodiment that are identical to those of the above-described embodiment may be omitted or simplified. The MIMO antenna 2 is a multi-antenna including a ground plane 70, a dipole antenna element 30, and a dipole antenna element 40.

The dipole antenna elements 30 and 40 are arranged in the vicinity of the corner portion 73 of the ground plane 70, for example. The dipole antenna element 30 includes a radiating element 31 as a radiating element having a conductor portion extending in a direction perpendicular to the extending direction of a conductor portion of the dipole antenna element 40. The dipole antenna element 40 includes a radiating element 41 as a radiating element having the conductor portion extending perpendicular to the extending direction of the conductor portion of the dipole antenna element 30. Note that the dipole antenna element 40 has a configuration substantially similar to that of the dipole antenna element 30, and as such, the following descriptions of the dipole antenna element 30 apply to the dipole antenna element 40.

The radiating element 31 of the dipole antenna element 30 includes a conductor portion extending perpendicular to the extending direction of the conductor portion of the radiating element 41 of the other dipole antenna element 40. The conductor portion of the radiating element 31 is a linear antenna conductor portion arranged along the outer edge portion 71, and may be spaced apart from the outer edge portion 71 by a predetermined distance D1 in the X-axis direction and extend parallel to the outer edge portion 71 in the Y-axis direction, for example. By arranging the radiating element 31 to have the conductor portion along the outer edge portion 71, the directivity of the MIMO antenna 2 may be easily controlled, for example. Also, in a case where the radiating element 31 and the outer edge portion 71 are spaced apart in both the X-axis direction and a thickness direction (Z-axis direction), the shortest distance D2 between the radiating element 31 and the outer edge portion 71 corresponds to the distance of a straight line connecting sections of the radiating element 31 and the outer edge portion 71 that are closest to each other.

The dipole antenna element 30 includes a feeding portion 36 for feeding the radiating element 31, and a feeding element 37 corresponding to a conductor that is spaced apart from the radiating element 31 by a predetermined distance in the Z-axis direction. Note that in FIG. 2, the radiating element 31 and the feeding element 37 overlap in plan view in the Z-axis direction; however, the radiating element 31 and the feeding element 37 do not necessarily have to overlap in plan view in the Z-axis direction as long as the feeding element 37 and the radiating element 31 are not in contact with each other and are spaced apart by a distance that enables feeding. For example, the radiating element 31 and the feeding element 37 may overlap in plan view in any direction such as the X-axis or the Y-axis direction.

The feeding element 37 and the radiating element 31 are spaced apart by a distance that enables electromagnetic field coupling of these elements. Non-contact feeding of the radiating element 31 at the feeding portion 36 via the feeding element 37 may be implemented by electromagnetic field coupling. By being fed in the above-described manner, the radiating element 31 may function as a radiating conductor of an antenna. As illustrated in FIG. 2, in a case where the radiating element 31 is a linear conductor connecting two points, a resonant current (distribution) similar to that of a half-wavelength dipole antenna may be formed on the radiating element 31. That is, the radiating element 31 may function as a dipole antenna that resonates at a half wavelength of a predetermined frequency (hereinafter referred to as dipole mode).

Electromagnetic field coupling refers to coupling that utilizes a resonance phenomenon of an electromagnetic field as disclosed, for example, in the following non-patent literature: A. Kurs et. al., "Wireless Power Transfer via Strongly Coupled Magnetic Resonances," Science Express, Vol. 317, No. 5834, pp. 83-86, July 2007. Electromagnetic field coupling, also referred to as "electromagnetic field resonance coupling" or "electromagnetic field resonant coupling," is a technique in which resonators that resonate at the same frequency are brought close to each other, one of the resonators is caused to resonate to generate a near field (non-radiation field area) between the resonators, and energy is transmitted to another one of the resonators via coupling at the near field. Also, electromagnetic field coupling refers to coupling via an electric field and a magnetic field at a high frequency excluding electrostatic capacitive coupling and electromagnetic induction coupling. Here, "excluding electrostatic capacitive coupling and electromagnetic induction coupling" does not necessarily mean electrostatic capacitive coupling and electromagnetic induction coupling are completely eliminated, but indicates that their influence is negligible. A medium between the feeding element 37 and the radiating element 31 may be air or a dielectric material such as glass or resin. It is preferable to not place a conductor material such as a ground plane or a display between the feeding element 37 and the radiating element 31.

By coupling the feeding element 37 and the radiating element 31 through electromagnetic field coupling, a durable structure that is resistant to impact may be obtained. That is, by utilizing electromagnetic field coupling, feeding of the radiating element 31 may be implemented using the feeding element 37 without requiring physical contact between the radiating element 31 and the feeding element 37, and thus, a durable structure that is resistant to impact may be obtained as compared to a contact type feeding mechanism that requires physical contact between the feeding element and the radiating element.

By coupling the feeding element 37 and the radiating element 31 through electromagnetic field coupling, non-contact feeding may be easily implemented. That is, by utilizing electromagnetic field coupling, feeding of the radiating element 31 may be implemented using the feeding element 37 without requiring physical contact between the radiating element 31 and the feeding element 37, and thus, feeding may be performed with a simpler configuration as compared to a contact-type feeding mechanism requiring physical contact. Also, by utilizing electromagnetic field coupling, feeding of the radiating element 31 using the feeding element 37 may be implemented without requiring extra components such as a capacitor plate, and thus, feeding may be implemented with a simpler configuration as compared to feeding using electrostatic capacitive coupling.

Also, as compared with feeding using electrostatic capacitive coupling, when feeding using electromagnetic field coupling is implemented, the total efficiency (antenna gain) of the radiating element 31 may be less likely to decrease even if the distance between the feeding element 37 and the radiating elements 31 (coupling distance) is increased. Note that the total efficiency is calculated as the radiation efficiency×return loss of the antenna, and the total efficiency is defined as the efficiency of the antenna with respect to the input power. Therefore, by coupling the feeding element 37 and the radiating element 31 through electromagnetic field coupling, a greater degree of freedom for determining the arrangement positions of the feeding element 37 and the radiating element 31 may be obtained and position robustness may be increased. Note that when high position robustness is achieved, this means that the total efficiency of the radiating element 31 may be less likely to be affected even when variations occur in the arrangement positions of the feeding element 37 and the radiating element 31. Also, by obtaining a greater degree of freedom for determining the arrangement positions of the feeding element 37 and the radiating element 31, the space required for installing the dipole antenna elements 30 and 40 may be easily reduced.

Also, in FIG. 2, the feeding portion 36, corresponding to a part of the radiating element 31 that is fed by the feeding element 37, is positioned at a region between one end portion 34 and another end portion 35 of the radiating element 31 other than the central portion 90 (region between the central portion 90 and the end portion 34 or the end portion 35). By positioning the feeding portion 36 at a region of the radiating element 31 other than the region having the lowest impedance at the resonant frequency of the fundamental mode of the radiating element 31 (the central portion 90 in the present case) matching of the dipole antenna element 30 may be facilitated. The feeding portion 36 is defined by a region of the conductor portion of the radiating element 31 (corresponding to a portion of the radiating element 31 that is closest to the feeding element 37) that is closest to a feeding point 38 of the feeding element 37.

The impedance of the radiating element 31 becomes higher as the distance from the central portion 90 toward the end portion 34 or the end portion 35 of radiating element 31 increases. In the case of coupling at high impedance by electromagnetic field coupling, even when slight variations occur in the impedance between the feeding element 37 and the radiating element 31, its impact on impedance matching may be relatively small as long as the feeding element 37 and the radiating element 31 are coupled at a sufficiently high impedance of at least a certain level. Thus, to facilitate matching, the feeding portion 36 of the radiating element 31 is preferably positioned at a high impedance portion of the radiating element 31.

For example, to facilitate impedance matching of the dipole antenna element 30, the feeding portion 36 may be positioned at a region spaced apart from the region having the lowest impedance at the resonant frequency of the fundamental mode of the radiating element 31 (the central portion 90 in the present case) by a distance greater than equal to ⅛ of the total length of the radiating element 31 (preferably greater than or equal to ⅙ of the total length, and more preferably greater than or equal to ¼ of the total length). In FIG. 2, the total length of the radiating element 31 corresponds to L32, and the feeding portion 36 is positioned away from the central portion 90 toward the corner portion 73 of the ground plane 70.

The radiating element 41 of the dipole antenna element 40 includes a conductor portion that extends perpendicular to the extending direction of the conductor portion of the radiating element 31 of the dipole antenna elements 30 as described above. The dipole antenna element 40 includes a feeding portion 46 for feeding the radiating element 41, and a feeding element 47 corresponding to a conductor that is spaced apart from the radiating element 41 by a predetermined distance in the Z-axis direction. In FIG. 2, the radiating element 41, the feeding portion 46, and the feeding element 47 of the dipole antenna element 40 have configurations similar to those of the radiating element 31, the feeding portion 36, and the feeding element 37 of the dipole antenna element 30 except that the extending direction of the radiating element 31 and the extending direction of the radiating element 41 are orthogonal. As such, detailed descriptions of these elements will be omitted.

The feeding portion 36 and the feeding portion 46 are located at regions that are shifted from the central portions 90 of the radiating elements 31 and 41 in directions approaching each other. In this way, matching of the dipole antenna elements 30 and 40 may be facilitated, and transmission lines respectively connected to the feeding portions 36 and 46 can be brought closer to each other such that the space required for installing the dipole antenna elements 30 and 40 may be easily reduced.

The feeding element 37 is connected to the feeding point 38, which is connected to a transmission line such as a microstrip line. The feeding element 37 is a linear conductor that feeds the radiating element 31 via the feeding portion 36 without physical contact. In FIG. 2, the feeding element 37 is illustrated as an L-shaped element having a linear conductor extending in a direction parallel to the X-axis and perpendicular to the outer edge portion 71 of the ground plane 70, and a linear conductor extending parallel to the Y-axis and parallel to the outer edge portion. In FIG. 2, the feeding element 37 extends in the X-axis direction from the feeding point 38 as the starting point and bends in the Y-axis direction to extend in the Y-axis direction until reaching the end portion 39. The feeding element 47 has a configuration similar to that of the feeding element 37 except for the extending directions in the X-axis direction and the Y-axis direction.

Figure 3:
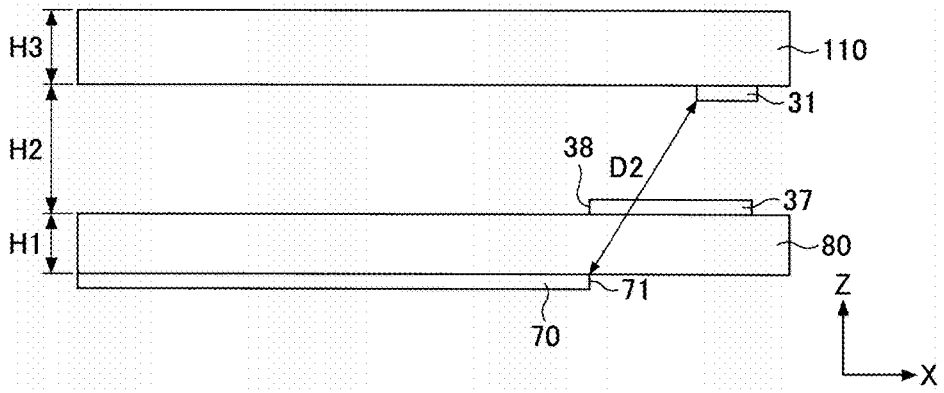
FIG. 3 is a diagram schematically illustrating an exemplary positional relationship between elements of a MIMO antenna.

FIG. 3 is a view schematically illustrating the positional relationship of the elements of the MIMO antenna 2 in the Z-axis direction. In FIG. 3, the feeding element 37 is arranged on the surface of the dielectric substrate 80; however, the feeding element 37 may also be installed inside the dielectric substrate 80. The radiating element 31 is spaced apart from the feeding element 37. For example, as illustrated in FIG. 3, the radiating element 31 may be arranged on a dielectric substrate 110 facing the dielectric substrate 80 and spaced apart from the dielectric substrate 80 by a distance H2. The dielectric substrate 110 may be a resin substrate, for example. However, a dielectric material other than resin such as glass, glass ceramic, LTCC, alumina, or the like may be used as well. Although the radiating element 31 is arranged on a surface of the dielectric substrate 110 facing the feeding element 37 in FIG. 3, the radiating element 31 may also be arranged on a surface on the opposite side of the surface facing the feeding element 37, or the radiating element 31 may be arranged on a side face of the dielectric substrate 110, for example.

Note that illustration of the dielectric substrate 110 of FIG. 3 is omitted in FIG. 2 for the sake of visibility. Also, the positional relationship between the radiating element 41 and the feeding element 47 in the Z-axis direction may be substantially the same as that of the radiating element 31 and the feeding element 37 illustrated in FIG. 3, and as such, a description thereof will be omitted.

Also, assuming $\lambda_0$ denotes the radio wave wavelength in vacuum at the resonant frequency of the fundamental mode of the radiating element 31, a shortest distance H4 ($\approx$H2>0) between the feeding element 37 and the radiating element 31 is preferably less than or equal to 0.2 $\lambda_0$ (more preferably less than or equal to 0.1 $\lambda_0$, and more preferably less than or equal to 0.05 $\lambda_0$). By arranging the radiating element 31 and the feeding element 37 to be spaced apart by the shortest distance H4 as described above, the total efficiency of the radiating element 31 may be improved.

Note that the shortest distance H4 refers to the linear distance between sections of the radiating element 31 and the feeding element 37 that are closest to each other. Also, the feeding element 37 and the radiating element 31 may be intersecting or they may not be intersecting when viewed from a given direction, and their intersecting angle may be at any angle as long as the feeding element 37 and the radiating element 31 are coupled by electromagnetic field coupling.

Also, a distance over which the feeding element 37 and the radiating element 31 run parallel to each other at a shortest distance x is preferably less than or equal to ⅜ of the physical length of the radiating element 31. More preferably, the distance is less than or equal to ¼ of the physical length, and more preferably less than or equal to ⅛ of the physical length. The location where the feeding element 37 and the radiating element 31 are at the shortest distance x corresponds to where coupling between the feeding element 37 and the radiating element 31 is strong, and when the distance over which the feeding element 37 and the radiating element 31 run parallel to each other at the shortest distance x is too long, strong coupling may occur at both a high impedance portion and a low impedance portion of the radiating element 31, and as such, impedance matching may become difficult. Thus, to obtain strong coupling only at a region where there is little variation in the impedance of the radiating element 31, the distance over which the feeding element 37 and the radiating element 31 run parallel to each other at the shortest distance x is preferably arranged to be relatively short, and in this way, advantageous effects may be achieved in terms of impedance matching.

Also, assuming Le37 denotes the electrical length that imparts the fundamental mode of resonance to the feeding element 37, Le31 denotes the electrical length that imparts the fundamental mode of resonance to the radiating element 31, and λ denotes a wavelength on the feeding element 37 or the radiating element 31 at a resonant frequency f of the fundamental mode of the radiating element 31, Le37 is preferably less than or equal to (⅜)λ, and Le31 is preferably greater than or equal to (⅜)λ and less than or equal to (⅝)λ.

Also, when the ground plane 70 is formed such that the outer edge portion 71 extends along the radiating element 31, a resonance current (distribution) can be formed on the feeding element 37 and the ground plane 70 as a result of an interaction between the feeding element 37 and the outer edge portion 71, and the feeding element 37 resonates and is coupled with the radiating element 31 by electromagnetic field coupling. For this reason, there is no specific lower limit for the electrical length Le37 of the feeding element 37 as long as the feeding element 37 has a physical length that is sufficient to be coupled to the radiating element 31 by electromagnetic field coupling.

Also, in order to allow a greater degree of freedom in the shape of the feeding element 37, the electrical length Le37 is preferably greater than or equal to (⅛)λ and less than or equal to (⅜)λ, and more preferably greater than or equal to (3/16)λ and less than or equal to (5/16)λ. By arranging the electrical length Le37 to be within the above ranges, resonance of the feeding element 37 may occur at the design frequency (resonant frequency f) of the radiating element 31, and in this way, the feeding element 37 and the radiating element 31 may resonate without depending on the ground plane 70 and desirable electromagnetic field coupling may be achieved.

Note that when electromagnetic field coupling is achieved this means that impedance matching is achieved. Also, in this case, the feeding element 37 does not have to be designed to have a suitable electrical length according to the resonant frequency of the radiating element 31, and the feeding element 37 may be freely designed as a radiating conductor. In this way, the dipole antenna element 30 may be easily designed to support multiple frequencies. Note that the sum of the length of the outer edge portion 71 of the ground plane 70 extending along the radiating element 31 and the electrical length of the feeding element 37 is preferably greater than or equal to (¼)λ of the design frequency (resonant frequency f). When the feeding element 37 does not include a component such as a matching circuit, a physical length L37 of the feeding element 37 is determined by $\lambda_{g1}=\lambda_0 k_1$, where $\lambda_0$ denotes the radio wave wavelength in vacuum at the resonant frequency of the fundamental mode of the radiating element 31, and $k_1$ denotes a shortening coefficient of a wavelength shortening effect in an actual environment. Here, $k_1$ is calculated based on, for example, a relative permittivity and a relative permeability of a medium (environment) such as an effective relative permittivity ($\in_{r1}$) and an effective relative permeability ($\mu_{r1}$) of the dielectric substrate at which the feeding element is arranged, a thickness of the medium (environment), and a resonant frequency. That is, L37 is less than or equal to (⅜) $\lambda_{g1}$. The shortening coefficient may be calculated based on the physical properties described above, or by actual measurement. For example, a resonant frequency of a target element placed in an environment whose shortening coefficient is to be obtained may be measured, a resonance frequency of the same target element may be measured in an environment whose shortening coefficient for each frequency is known, and the shortening coefficient may be calculated based on a difference between the measured resonance frequencies.

The physical length L37 (corresponding to D1+L31 in FIG. 2) of the feeding element 37 is a physical length that gives Le37. In an ideal case where no other factor is considered, the physical length L37 is equal to Le37. When the feeding element 37 includes a matching circuit, for example, L37 is preferably greater than zero and less than or equal to Le37. By using a matching circuit such as an inductor, L37 can be reduced (i.e., the size of the feeding element 37 can be reduced).

When the fundamental mode of resonance of the radiating element 31 is the dipole mode (i.e., when the radiating element 31 is a linear conductor having open ends), Le31 is preferably greater than or equal to (⅜)λ and less than or equal to (⅝)λ, more preferably greater than or equal to (7/16)λ and less than or equal to (9/16)λ, and more preferably greater than or equal to (15/32)λ and less than or equal to (17/32)λ. When a higher-order mode is taken into account, Le31 is preferably greater than or equal to (⅜) λm and less than or equal to (⅝) λm, more preferably greater than or equal to (7/16) λm and less than or equal to (9/16) λm, and more preferably greater than or equal to (15/32) λm and less than or equal to (17/32) λm. Here, m denotes a mode number of a higher-order mode and is represented by a natural number. The value of m is preferably an integer between 1 through 5, and more preferably an integer between 1 through 3. In this case, m=1 represents the fundamental mode. When Le31 is within the above ranges, the radiating element 31 may function sufficiently as a radiating conductor, and the efficiency of the dipole antenna element 30 may be desirably high.

A physical length L31 of the radiating element 31 is determined by $\lambda_{g2}=\lambda_0 k_2$, where $\lambda_0$ denotes the radio wave wavelength of in vacuum at the resonant frequency of the fundamental mode of the radiating element 31, and $k_2$ denotes a shortening coefficient of a wavelength shortening effect in an actual environment. Here, $k_2$ is calculated based on, for example, a relative permittivity and a relative permeability of a medium (environment) such as an effective relative permittivity ($\in_{r2}$) and an effective relative permeability ($\mu_{r2}$) of the dielectric substrate at which the radiating element 31 is arranged, a thickness of the medium (environment), and a resonant frequency. That is, in an ideal case, the fundamental mode of resonance of the radiating element 31 is the dipole mode and L31 is equal to (½) $\lambda_{g2}$. The physical length L31 of the radiating element 31 is preferably greater than or equal to (¼) $\lambda_{g2}$ and less than or equal to (⅝) $\lambda_{g2}$, and more preferably greater than or equal to (⅜) $\lambda_{g2}$. The physical length L31 of the radiating element 31 is a physical length that gives Le31. In an ideal case where no other factor is considered, the physical length L31 is equal to Le31. Even when L31 is reduced by using a matching circuit such as an inductor, for example, L31 is preferably greater than zero and less than or equal to Le31, and more preferably greater than or equal to 0.4×Le31 and less than or equal to 1×Le31. By adjusting the length L31 of the radiating element 31 to such a length, the total efficiency of the radiating element 31 may be improved.

For example, when BT resin (registered trademark) CCL-HL870 (M) (Mitsubishi Gas Chemical Company, Inc.) with a relative permittivity $\in_r$ of 3.4, a loss tangent tan δ of 0.003, and a substrate thickness of 0.8 mm is used as a dielectric substrate, L37 is 20 mm when the design frequency of the feeding element 37 used as a radiating conductor is 3.5 GHz, and L31 is 34 mm when the design frequency of the radiating element 31 is 2.2 GHz.

Note that electromagnetic field coupling of the feeding element 47 and the radiating element 41 and the relationship of their lengths may be similar to those of the feeding element 37 and the radiating element 31 as described above. As such, descriptions thereof will be omitted.

The radiating element 31 is an antenna conductor that functions as an antenna operating in dipole mode by being fed by the feeding element 37 in a non-contact manner at the feeding portion 36 (through electromagnetic field coupling in particular). Similarly, the radiating element 41 is an antenna conductor that functions as an antenna operating in dipole mode by being fed by the feeding element 47 in a non-contact manner at the feeding portion 46 (through electromagnetic field coupling in particular).

<Correlation Coefficient between Antenna Elements>

In a MIMO antenna according to an embodiment of the present invention, the correlation coefficient between dipole antenna elements may be low, and thus, the distance between the dipole antenna element and the outer edge portion of a ground plane may be freely designed. In particular, as compared to a configuration using monopole antenna elements, in the MIMO antenna according to the present embodiment, the dipole antenna element and the outer edge portion of the ground plane may be arranged closer to each other. That is, assuming $\lambda_0$ denotes the radio wave wavelength of in vacuum at the design frequency of the fundamental mode of the radiating element of the dipole antenna element, the shortest distance D2 (>0) between the radiating element and the outer edge portion of the ground plane may be arranged to be less than or equal to 0.05 $\lambda_0$. Further, the distance D2 may be arranged to be less than or equal to 0.043 $\lambda_0$. Further, the distance D2 may be arranged to be less than or equal to 0.034 $\lambda_0$. By arranging the distance D2 to be within these ranges, the installation space of the dipole antenna elements may be reduced while maintaining a low correlation coefficient between the dipole antenna elements. For example, in a case where the design frequency is set to 2.5 GHz, the distance D2 is preferably less than or equal to 6 mm, and more preferably less than or equal to 5 mm. Still more preferably, the distance D2 is less than or equal to 4 mm.

In the following, the correlation coefficient between antenna elements is described by comparing a case of using monopole antenna elements with the case of using dipole antenna elements according to an embodiment of the present invention.

Figure 4:
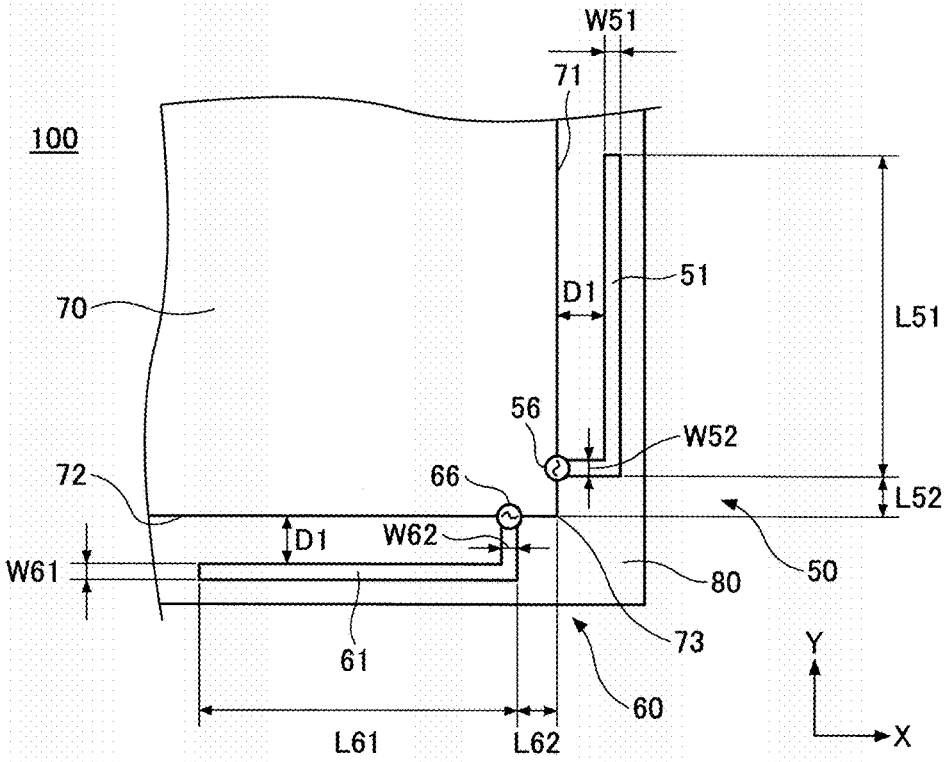
FIG. 4 is a plan view of a MIMO antenna including a plurality of monopole antenna elements having radiating elements that are orthogonal.

FIG. 4 is a plan view of a MIMO antenna 100 using two monopole antenna elements 50 and 60 in contrast to an embodiment of the present invention. The monopole antenna elements 50 and 60 are L-shaped antenna conductors that are arranged in the vicinity of the corner portion 73 of the ground plane 70. The monopole antenna element 50 includes a radiating element 51 that is fed via a feeding point 56, and the monopole antenna element 60 includes a radiating element 61 that is fed via a feeding point 66. The radiating elements 51 and 61 are mounted on the dielectric substrate 80.

Figure 5:
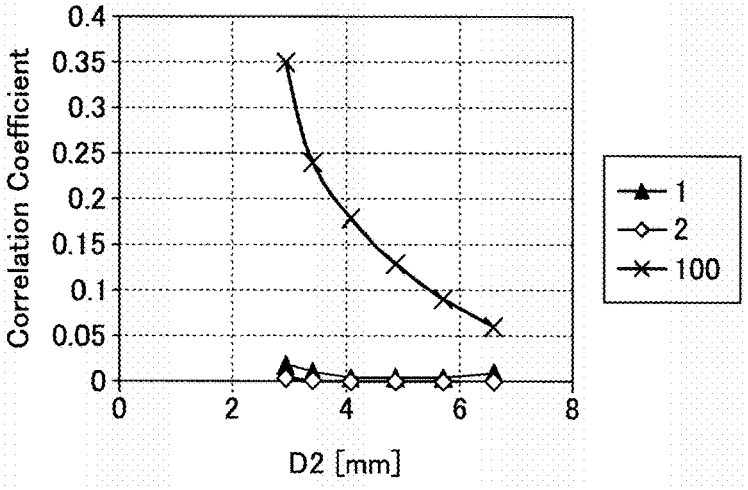
FIG. 5 is a graph showing a relationship between a distance D2 between an antenna element and a ground plane, and a correlation coefficient between antenna elements.

FIG. 5 is a graph indicating a relationship between the shortest distance D2 between a radiating element of an antenna element and the outer edge portion of the ground plane 70 and the correlation coefficient between the antenna elements. FIG. 5 illustrates a case where the resonant frequency of the radiating element is fixed to 2.5 GHz (that is, the total length of the radiating element is fixed). FIG. 5 shows changes in the correlation coefficient between the antenna elements as the distance D2 is changed by changing the distance D1 from the ground plane 70 in the X-axis direction or the Y-axis direction. The correlation coefficient was calculated based on the following equation.

$$\rho = \frac{|S_{11} * S_{21} + S_{21} * S_{22}|^2}{(1 - (|S_{11}|^2 + |S_{21}|^2))(1 - (|S_{22}|^2 + |S_{12}|^2))} \quad \text{[Equation 1]}$$

In the MIMO antenna 100 that uses the monopole antenna elements 50 and 60, the correlation coefficient increases (the antenna gain decreases) as the radiating elements 51 and 61 come closer to the ground plane 70. That is, in order to improve the antenna gain, the distance D2 has to be increased. As a result, unnecessary space between the radiating elements 51 and 61 and the outer edge portions 71 and 72 of the ground plane 70 have to be secured and the installation space is enlarged.

In contrast, the dipole antenna elements used in the MIMO antennas 1 and 2 according to embodiments of the present invention do not use the ground plane, and thus, even when the radiating elements are brought closer to the ground plane, the correlation coefficient between the dipole antenna elements may be maintained at a low value. That is, the installation space of the dipole antennas may be reduced and the correlation coefficient between the dipole antenna elements may be lowered at the same time.

The plurality of dipole antenna elements according to embodiments of the present invention as described above have radiating elements with conductor portions extending in orthogonal directions (e.g., in the MIMO antenna 1 of FIG. 1, the extending direction of the conductor portions 12 and 13 of the radiating element 11 and the extending direction of the conductor portions 22 and 23 of the radiating element 21 are orthogonal). However, the correlation coefficient between the dipole antenna elements can be reduced as long as dipole antenna elements are used, and as such, the radiating elements of the dipole antennas do not necessarily have to be orthogonally arranged. For example, the extending directions of the conductor portions of the radiating elements of the plurality of dipole antenna elements may be arranged to be parallel or oblique to one another.

<Multiband Application>

Also, a MIMO antenna according to an embodiment of the present invention has a plurality of dipole antenna elements, and as such, it may be easily implemented in multiband applications supporting a combination of the fundamental mode of the radiating element, and a higher-order mode in which the radiating element resonates at an integer multiple of the resonant frequency of the fundamental mode. In contrast, the MIMO antenna using a plurality of monopole antenna elements may not be suitable for multiband applications because the gap between the resonant frequency of the higher-order mode and the resonant frequency of the fundamental mode is too wide (the resonant frequency of the second order mode is three times that of the fundamental mode).

Figure 6:
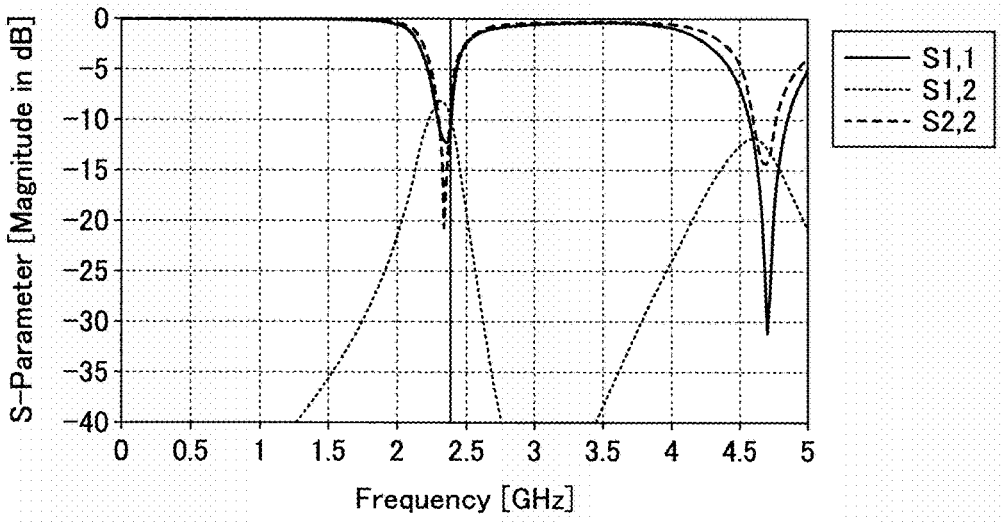
FIG. 6 is a graph showing S-parameters of the MIMO antenna including dipole antenna elements.
Figure 7:
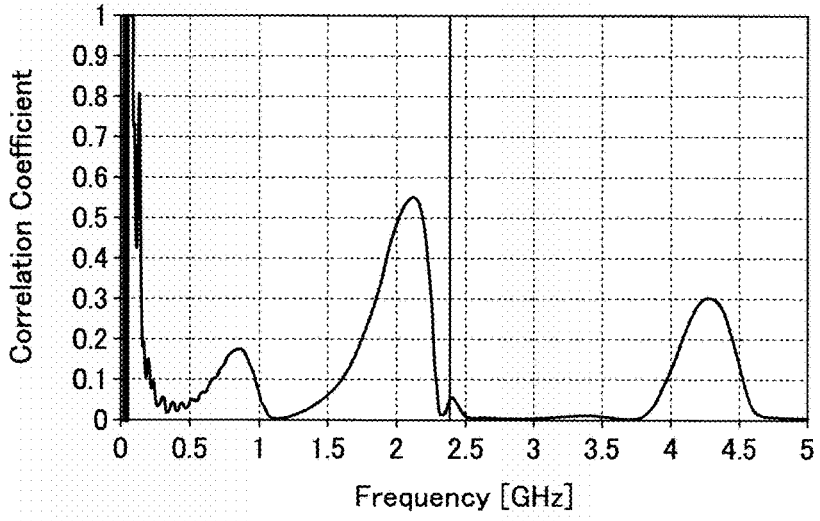
FIG. 7 is a graph showing correlation coefficient characteristics of the MIMO antenna including dipole antenna elements.

FIG. 6 is a graph indicating S-parameter characteristics of the MIMO antenna 1 that is designed to operate at a fundamental mode resonant frequency of 2.4 GHz. FIG. 7 is a graph indicating the correlation coefficient at each frequency of the MIMO antenna 1 that is designed to operate at a fundamental mode resonant frequency of 2.4 GHz. As illustrated in FIGS. 6 and 7, resonance of the second order mode occurs at around 4.8 GHz, which is approximately twice the fundamental mode resonant frequency 2.4 GHz, and the correlation coefficient at each of the resonant frequencies is low. That is, a multiband antenna that is capable of receiving signals on a frequency band of around 2.4 GHz and a frequency band of around 4.8 GHz at a relatively high antenna gain may be realized.

<Offset of Feeding Portion>

When the dipole antenna elements and the ground plane are brought too close to each other, the radiation resistance of the radiating elements is reduced due to coupling of the radiating elements and the ground plane such that impedance matching of the MIMO antenna becomes difficult. However, in a MIMO antenna according to an embodiment of the present invention, the feeding portion is arranged at a region other than the central portion of the radiating element (e.g., portion having higher impedance than the central portion), and in this way, impedance matching of the MIMO antenna may be facilitated. Also, the distance D2 between the radiating element of the dipole antenna element and the outer edge portion of the ground plane can be easily reduced such that the installation space of the dipole antenna elements may be reduced and the antenna gain of the MIMO antenna may be improved at the same time.

In particular, when the distance D2 is arranged to be less than or equal to 0.05 $\lambda_0$ (preferably less than or equal to 0.043 $\lambda_0$, and more preferably less than or equal to 0.034 $\lambda_0$), impedance matching of the dipole antenna element may be facilitated by offsetting the feeding portion from the central portion of the radiating element. For example, when the distance D2 is arranged to be less than or equal to 0.05 $\lambda_0$ (preferably less than or equal to 0.043 $\lambda_0$, and more preferably less than or equal to 0.034 $\lambda_0$), the feeding portion is preferably offset from the central portion of the radiating element by a distance greater than or equal to ⅛ of the total length of the radiating element (preferably greater than or equal to ⅙ of the total length, and more preferably greater than or equal to ¼ of the total length).

Figure 8:
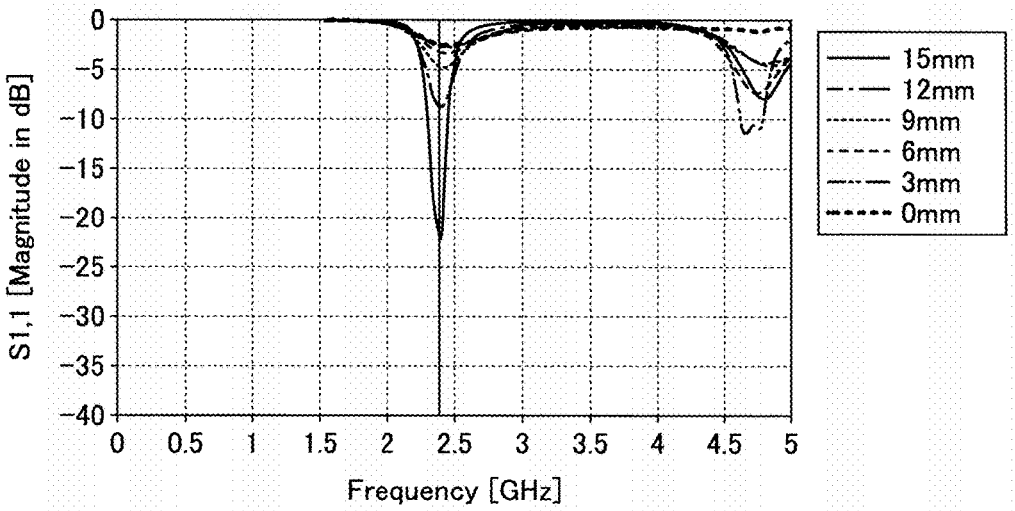
FIG. 8 is a graph showing S-parameter characteristics upon changing an offset distance between a central portion of a radiating element and a feeding portion.

FIG. 8 is a graph showing changes in S-parameters upon changing an offset distance corresponding to the distance between the feeding portion 16 (or the feeding portion 26) and the central portion 90 of the MIMO antenna 1 that is designed to operate at a fundamental mode resonant frequency of 2.4 GHz. In the measurement of FIG. 8, the distance D2 is set to 2.8 mm in order to evaluate the influence of the offset distance on the reflection loss (return loss) of the MIMO antenna 1. As illustrated in FIG. 8, the reflection loss may be reduced as the offset distance is increased (as the feeding portions 16 and 26 are brought closer to the end portions 14 and 24 in the case of FIG. 1), and impedance matching of the MIMO antenna 1 may be facilitated as a result.

<MIMO Antenna-Implemented Device>

A MIMO antenna according to an embodiment of the present invention may be implemented in a wireless device (e.g., wireless communication device such as a portable communication terminal). Specific examples of the wireless device include electronic devices such as an information terminal, a mobile phone, a smartphone, a personal computer, a game console, a TV, a music/video player, and the like.

For example, in FIG. 3, when the MIMO antenna 2 is implemented in a wireless communication device including a display, the dielectric substrate 110 may be a cover glass covering the entire face of an image display surface of the display, for example, and the dielectric substrate 80 may be a fixed housing (top cover, back cover, side wall, etc.), for example. The cover glass is a plate-shaped member that is stacked on the display and corresponds to a dielectric substrate that is transparent or semi-transparent to the extent it can retain adequate visibility of an image displayed on the display.

If the radiating element 31 is arranged on the surface of the cover glass, the radiating element 31 may be formed by applying a conductive paste such as copper or silver on the surface of the cover glass and firing the applied conductive paste, for example. The conductive paste used in this case is preferably a conductive paste that can be fired at a sufficiently low temperature that would not weaken the strength of the chemically strengthened glass that is used for the cover glass. Also, plating may be performed in order to prevent deterioration of the conductor due to oxidation, for example. Also, the cover glass may be subjected to decorative printing, and a conductor may be formed on the decorative printed portion. Also, in a case where a black concealing layer is formed at the peripheral edges of the cover glass in order to conceal wiring and the like, the radiating element 31 may be formed on the black concealing layer.

Also, the positions of the feeding elements 37, 47, the radiating elements 31, 41, and the ground plane 70 in the height direction parallel to the Z-axis may be different from each other. Alternatively, the positions of the feeding elements 37 and 47, the radiating elements 31 and 41, and the ground plane 70 in the height direction may all be the same or partially the same.

Also, in some embodiments, one feeding element 37 may be configured to feed a plurality of radiating elements. By utilizing a plurality of radiating elements, implementation of multiband operations, wideband operations, and directivity control may be facilitated, for example. Further, a plurality of MIMO antennas may be implemented in a single wireless device.

APPLICATION EXAMPLE 1

In the following, S11 characteristics, correlation coefficient characteristics, and total efficiency characteristics (antenna gain characteristics) obtained from the simulation analyses of the MIMO antennas illustrated in FIGS. 1-4 are described. Specifically, changes in the above characteristics upon changing the shortest distance D2 by changing the distance D1 1 mm at a time from 1 mm to 6 mm are described. S11characteristics refer to a certain type of characteristics of high frequency electronic components and the like. In the present descriptions, the S11 characteristics are represented by a return loss with respect to a frequency. Also, the Microwave Studio (registered trademark) (manufactured by CST Co., Ltd.) was used as the electromagnetic field simulator. The fundamental mode resonant frequency of the radiating elements was set in the vicinity of 2.4 GHz.

The dimensions of the configuration illustrated in FIG. 1 upon characteristic measurement were set up as follows (in mm).

L11, L21: 4
L12, L22: 34
L13, L23: 3.5
W11, W21: 1.9

The dimensions of the configuration illustrated in FIG. 2 upon characteristic measurement were set up as follows (in mm).

L31, L41: 10.95
L32, L42: 30
L33, L43: 4.05
W31, W41: 1.9
W32, W42: 1.9
W33, W43: 1

The dimensions of the configuration illustrated in FIG. 4 upon characteristic measurement were set up as follows (in mm).

L51, L61: 22.95 (D1=1)
L51, L61: 21.95 (D1=2)
L51, L61: 20.95 (D1=3)
L51, L61: 19.95 (D1=4)
L51, L61: 18.95 (D1=5)
L51, L61: 17.95 (D1=6)
L52, L62: 5
W51, W61: 1.9
W52, W62: 1.9

Also, the thickness (height) in the Z-axis direction of the ground plane 70, the feeding elements, and the radiating elements was set to 0.018 mm. The dielectric substrate 80 was arranged to have a relative permittivity of $\in_r$=3.3 and a loss tangent of tan δ=0.003, and the dielectric substrate 110 was arranged to have a relative permittivity of $\in_r$=8.6 and a loss tangent of tan δ=0.000326. Also, in FIG. 3, H1 was set to 0.8 mm, H2 was set to 2 mm, and H3 was set to 1 mm. The shape of the ground plane 70 was arranged into a rectangle with sides of 50 mm in the X-axis direction and 120 mm in the Y-axis direction, the shape of the dielectric substrate 80 was arranged into a rectangle with sides of 60 mm in the X-axis direction and 130 mm in the Y-axis direction.

Figure 9:
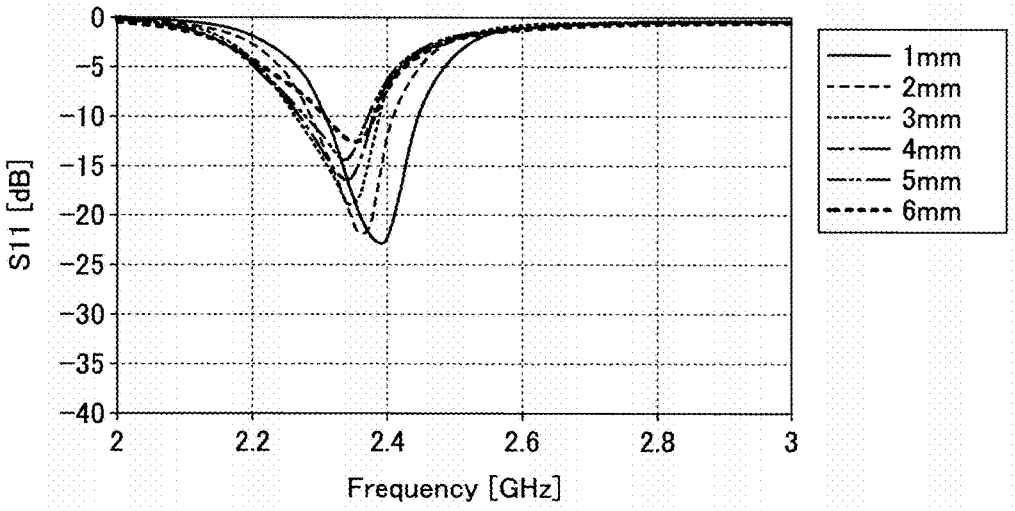
FIG. 9 is a graph showing S11 characteristics upon changing a distance D1 between a radiating element and a ground plane of the MIMO antenna including dipole antenna elements with radiating elements that are orthogonal.
Figure 10:
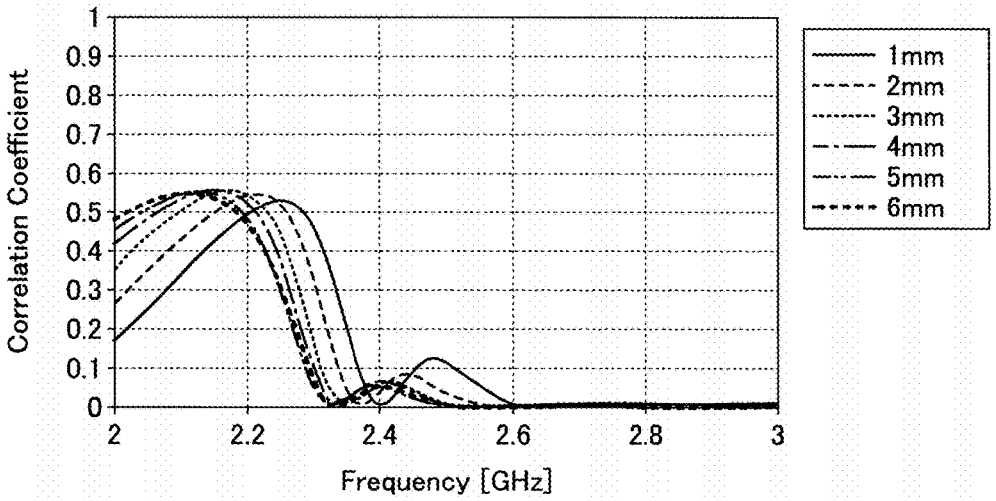
FIG. 10 is a graph showing correlation coefficient characteristics upon changing the distance D1 of the MIMO antenna including dipole antenna elements with radiating elements that are orthogonal.
Figure 11:
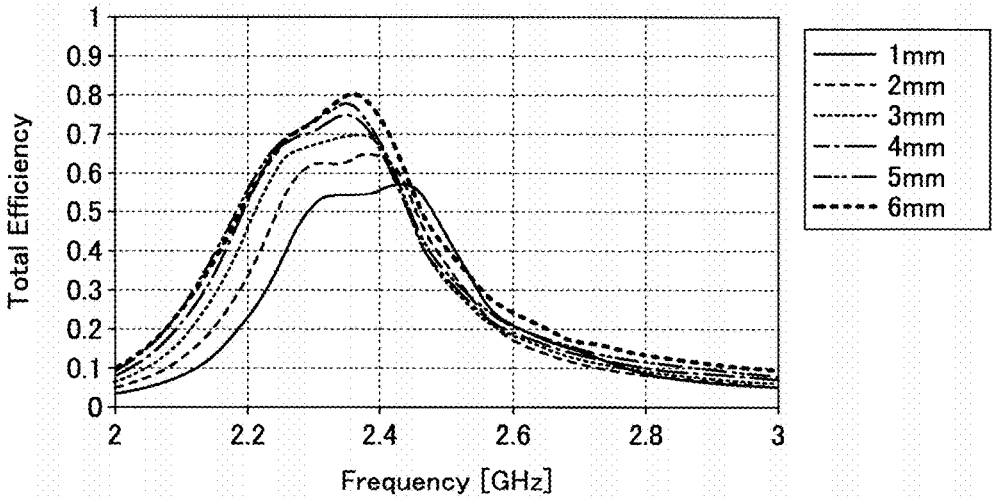
FIG. 11 is a graph showing total efficiency characteristics upon changing the distance D1 of the MIMO antenna including dipole antenna elements with radiating elements that are orthogonal.
Figure 12:
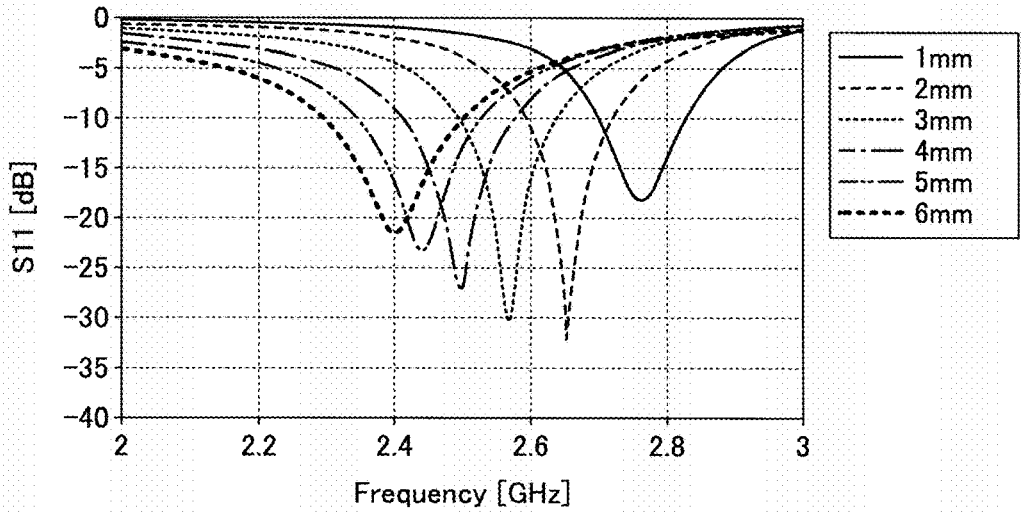
FIG. 12 is a graph showing S11 characteristics upon changing the distance D1 of the MIMO antenna including dipole antenna elements with radiating elements that are orthogonal and are coupled by electromagnetic field coupling.
Figure 13:
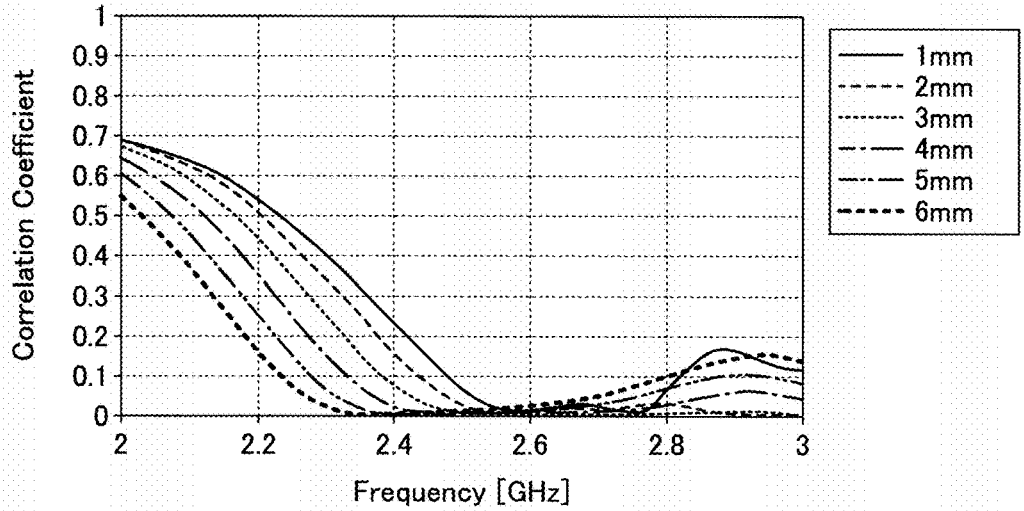
FIG. 13 is a graph showing correlation coefficient characteristics upon changing the distance D1 of the MIMO antenna including dipole antenna elements having radiating elements that are orthogonal and are coupled by electromagnetic field coupling.
Figure 14:
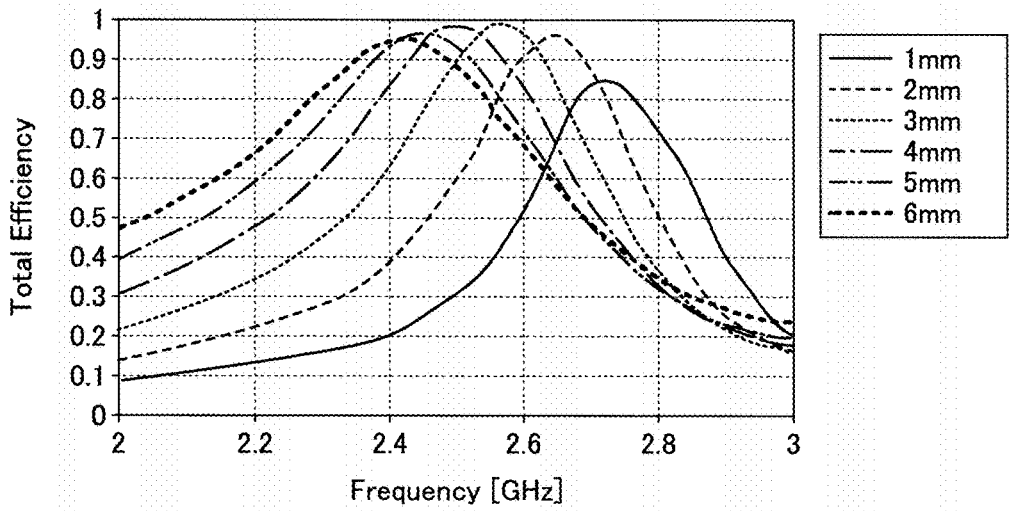
FIG. 14 is a graph showing total efficiency characteristics upon changing the distance D1 of the MIMO antenna including dipole antenna elements having radiating elements that are orthogonal and are coupled by electromagnetic field coupling.
Figure 15:
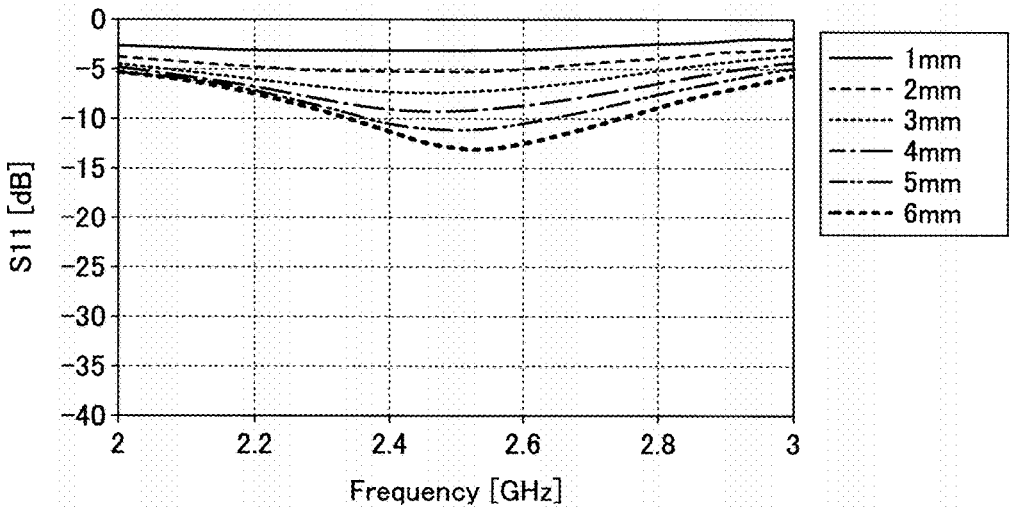
FIG. 15 is a graph showing S11 characteristics upon changing the distance D1 of the MIMO antenna including monopole antenna elements having radiating elements that are orthogonal.
Figure 16:
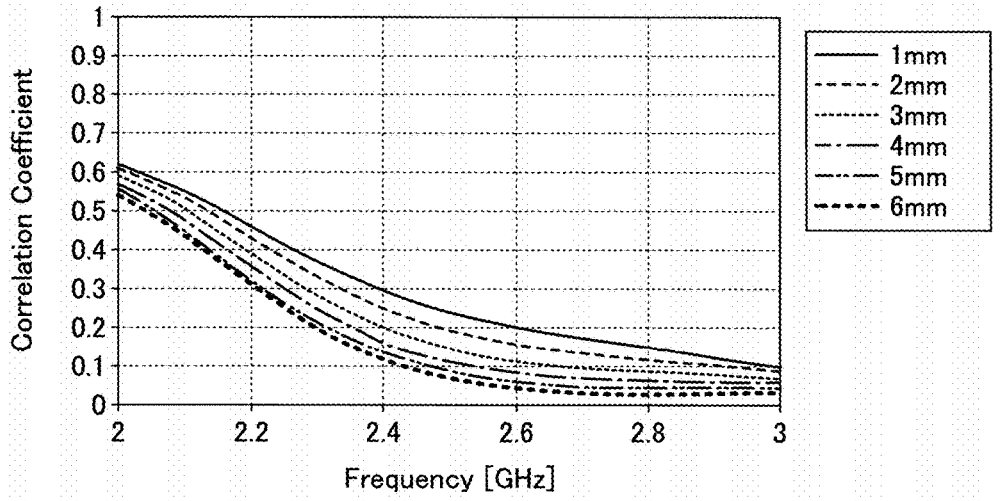
FIG. 16 is a graph showing correlation coefficient characteristics upon changing the distance D1 of the MIMO antenna including monopole antenna elements having radiating elements that are orthogonal.
Figure 17:
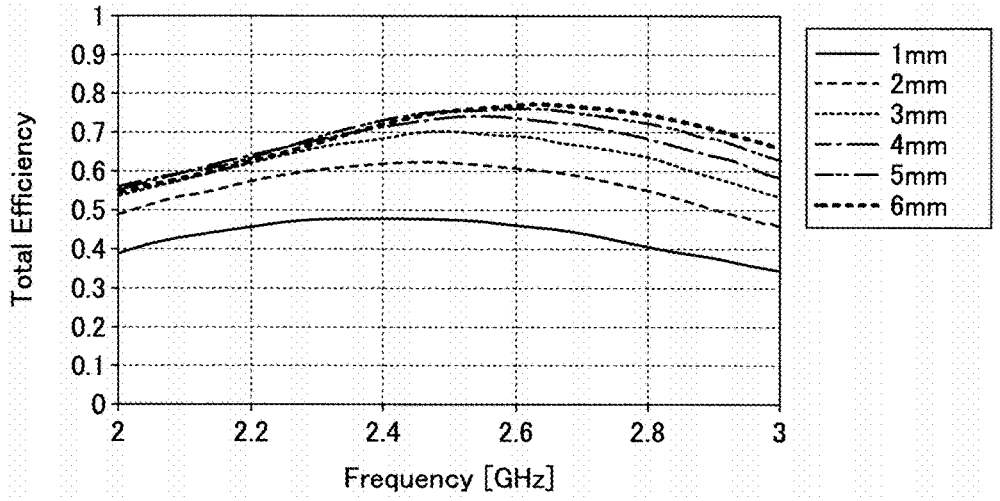
FIG. 17 is a graph showing total efficiency characteristics upon changing the distance D1 of the MIMO antenna including monopole antenna elements having radiating elements that are orthogonal.

FIG. 9 is a graph showing S11 characteristics of the MIMO antenna 1 using dipole antenna elements that are fed directly. FIG. 10 is a graph showing correlation coefficient characteristics of the MIMO antenna 1. FIG. 11 is graph showing total efficiency characteristics of the MIMO antenna 1. FIG. 12 is a graph showing S11 characteristics of the MIMO antenna 2 using dipole antenna elements that are fed by electromagnetic field coupling. FIG. 13 is a graph showing correlation coefficient characteristics of the MIMO antenna 2. FIG. 14 is a graph showing total efficiency characteristics of the MIMO antenna 2. FIG. 15 is a graph showing S11 characteristics of the MIMO antenna 100 using monopole antenna elements. FIG. 16 is a graph showing correlation coefficient characteristics of the MIMO antenna 100. FIG. 17 is a graph showing total efficiency characteristics of the MIMO antenna 100.

Note that in FIGS. 9 through 17, "1 mm," "2 mm," "3 mm," "4 mm," "5 mm," and "6 mm" represent the distance D1, and when converted into the shortest distance D2, they would respectively be "3 mm," "3.4 mm," "4.1 mm," "4.9 mm," "5.7 mm," and "6.6 mm."

The S11 of the MIMO antennas using dipole antenna elements (FIGS. 9 and 12) substantially decreases in the vicinity of the resonant frequency 2.4 GHz in contrast to the S11 of the MIMO antenna using monopole antenna elements (FIG. 15). Thus, it can be appreciated that better impedance matching at the resonant frequency may be achieved in the case of using dipole antenna elements as compared to the case of using monopole antenna elements.

Also, it can be appreciated that the correlation coefficients of the MIMO antennas using dipole antenna elements (FIGS. 10 and 13) substantially decrease to nearly 0 in the vicinity of the resonant frequency 2.4 GHz in contrast to the correlation coefficients of the MIMO antenna using monopole antenna elements (FIG. 16).

Meanwhile, it can be appreciated that the total efficiency of the MIMO antennas using dipole antenna elements (FIGS. 11 and 14) is substantially improved in the vicinity of the resonant frequency 2.4 GHz in contrast to the total efficiency of the MIMO antenna using monopole antenna elements (FIG. 17).

In this way, the installation space of the antenna elements may be reduced and the correlation coefficient between the antenna elements may be lowered at the same time.

APPLICATION EXAMPLE 2

In the following, comparison results of comparing the characteristics of the MIMO antennas 1, 2, and 100 having radiating elements with conductor portions that are orthogonal (FIGS. 1, 2, and 4) at the resonant frequencies at which best matching was obtained are described. Specifically, S11 characteristics, correlation coefficient characteristics, and total efficiency characteristics of the MIMO antennas upon changing the shortest distance D2 by changing the distance D1 1 mm at a time from 1 mm to 6 mm are compared.

Note that the dimensions of the configurations of FIGS. 1, 2, and 4 upon characteristic measurement were arranged to be the same as those of Application Example 1. Also, the thickness of the ground plane 70 and the feeding/radiating elements, and the dimensions of the dielectric substrate were arranged to be the same as those of Application Example 1.

TABLE 1

| Frequency at which minimum S11 is obtained [GHz] | 1 mm | 2 mm | 3 mm | 4 mm | 5 mm | 6 mm |
|---|---|---|---|---|---|---|
| MIMO Antenna 100 | 2.34 | 2.41 | 2.45 | 2.47 | 2.50 | 2.52 |
| MIMO Antenna 1 | 2.39 | 2.36 | 2.34 | 2.34 | 2.34 | 2.35 |
| MIMO Antenna 2 | 2.76 | 2.66 | 2.57 | 2.49 | 2.44 | 2.40 |

Table 1 indicates the frequencies at which the minimum S11 was obtained (i.e., resonant frequencies at which best matching was obtained) in the MIMO antennas 1, 2, and 100 according to the graphs showing the S11 characteristics of the MIMO antennas 1, 2, and 100 (FIGS. 9, 12, and 15).

TABLE 2

| Correlation Coefficient | 1 mm | 2 mm | 3 mm | 4 mm | 5 mm | 6 mm |
|---|---|---|---|---|---|---|
| MIMO Antenna 100 | 0.35 | 0.25 | 0.18 | 0.13 | 0.090 | 0.0064 |
| MIMO Antenna 1 | 0.020 | 0.010 | 0.0073 | 0.0059 | 0.0071 | 0.0011 |
| MIMO Antenna 2 | 0.011 | 0.00036 | 0.000024 | 0.00014 | 0.00058 | 0.0014 |

Table 2 indicates the correlation coefficients at the frequencies at which the minimum S11 was obtained in the MIMO antennas 1, 2, and 100 according to the graphs showing the correlation coefficient characteristics of the MIMO antennas 1, 2, and 100 (FIGS. 10, 13, and 16). It can be appreciated from Table 2 that the correlation coefficients of the MIMO antennas 1 and 2 using dipole antenna elements were lower than the correlation coefficients of the MIMO antenna 100 using monopole antenna elements.

TABLE 3

| Total Efficiency | 1 mm | 2 mm | 3 mm | 4 mm | 5 mm | 6 mm |
|---|---|---|---|---|---|---|
| MIMO Antenna 100 | 0.48 | 0.62 | 0.69 | 0.73 | 0.76 | 0.76 |
| MIMO Antenna 1 | 0.55 | 0.63 | 0.69 | 0.75 | 0.78 | 0.79 |
| MIMO Antenna 2 | 0.80 | 0.96 | 0.99 | 0.99 | 0.97 | 0.95 |

Table 3 indicates the total efficiencies of the MIMO antennas 1, 2, and 100 at the frequencies at which the minimum S11 was obtained according to the graphs showing the total efficiency characteristics of the MIMO antennas 1, 2, and 100 (FIGS. 11, 14, and 17). It can be appreciated from Table 3 that the total efficiencies of the MIMO antennas 1 and 2 using dipole antenna elements were higher than the total efficiencies of the MIMO antenna 100 using monopole antenna elements.

Note that in Table 1 through Table 3, "1 mm," "2 mm," "3 mm," "4 mm," "5 mm," and "6 mm" represent the distance D1, and when converted into the shortest distance D2, they would respectively be "3 mm," "3.4 mm," "4.1 mm," "4.9 mm," "5.7 mm," and "6.6 mm."

APPLICATION EXAMPLE 3

In the following, comparison results of comparing the characteristics of MIMO antennas 3, 4, and 101 having radiating elements with conductor portions that are parallel (FIGS. 18, 19, and 20) at the resonant frequencies at which best matching was obtained are described. Specifically, S11 characteristics, correlation coefficient characteristics, and total efficiency characteristics of the MIMO antennas upon changing the shortest distance D2 by changing the distance D1 1 mm at a time from 1 mm to 6 mm are compared.

Figure 18:
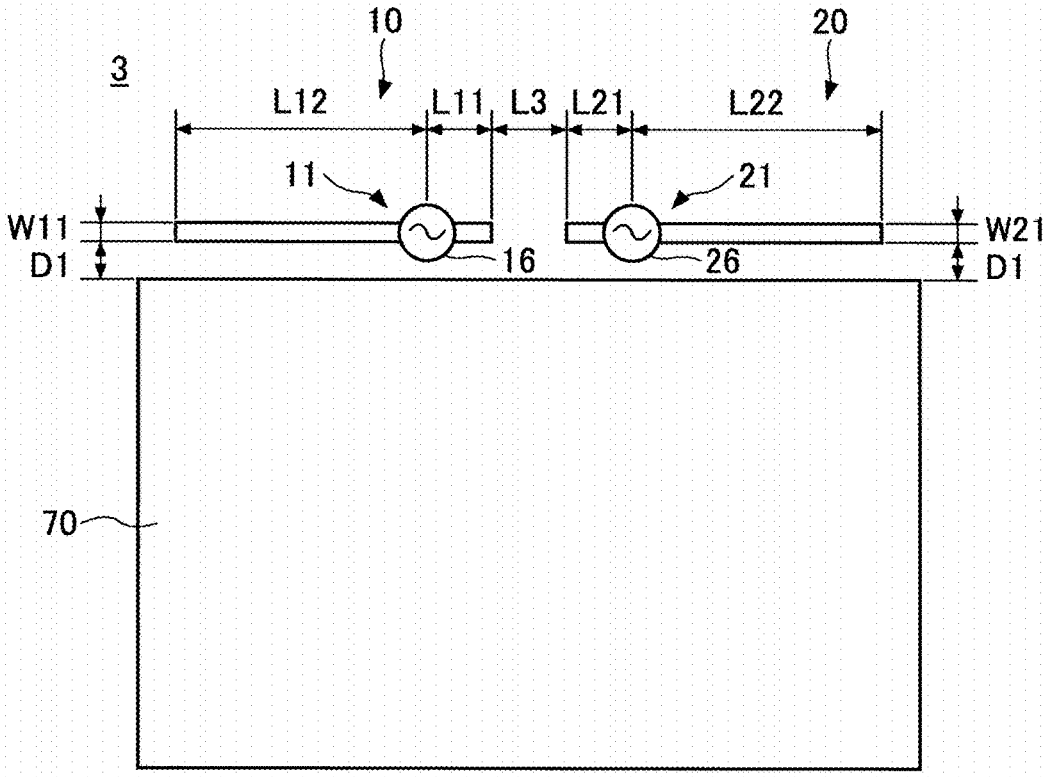
FIG. 18 is a plan view of a MIMO antenna including a plurality of dipole antenna elements having radiating elements that are parallel.

FIG. 18 is a plan view of a computer simulation model for analyzing the operation of the MIMO antenna 3 according to an embodiment of the present invention. The MIMO antenna 3 is a multi-antenna including a ground plane 70, and two dipole antenna elements 10 and 20. In the MIMO antenna 3, a radiating element 11 of the dipole antenna element 10, and a radiating element 21 of the dipole antenna element 20 have conductor portions extending parallel to one another.

Figure 19:
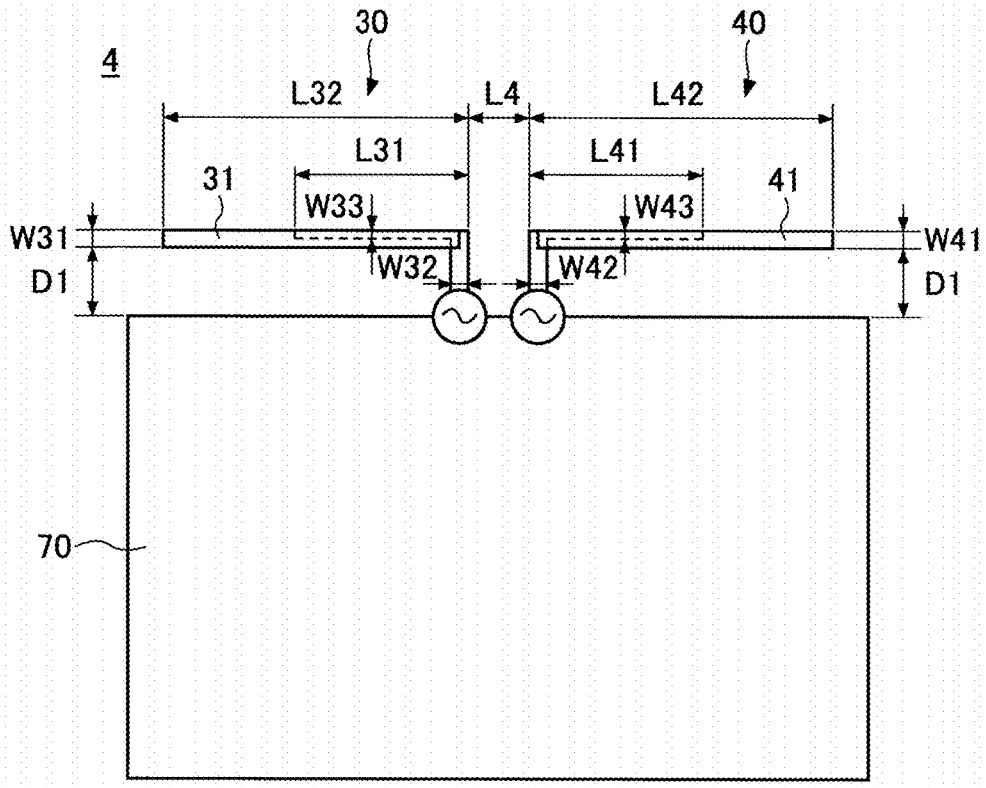
FIG. 19 is a plan view of a MIMO antenna including a plurality of non-contact feeding dipole antenna elements having radiating elements that are parallel.

FIG. 19 is a plan view of a computer simulation model for analyzing the operation of the MIMO antenna 4 according to an embodiment of the present invention. The MIMO antenna 4 is a multi-antenna including a ground plane 70, and two dipole antenna elements 30 and 40. In the MIMO antenna 4, a radiating element 31 of the dipole antenna element 30, and a radiating element 41 of the dipole antenna element 40 have conductor portions extending parallel to one another.

Figure 20:
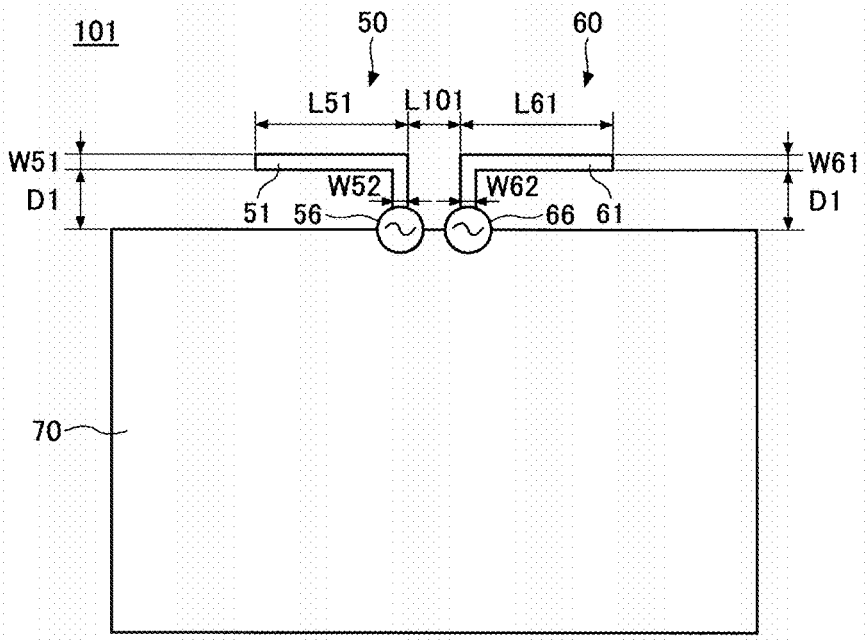
FIG. 20 is a plan view of a MIMO antenna including a plurality of monopole antenna elements having radiating elements that are parallel.

FIG. 20 is a plan view of a computer simulation model for analyzing the operation of the MIMO antenna 101 that uses monopole antenna elements in contrast to an embodiment of the present invention. The MIMO antenna 101 is a multi-antenna including a ground plane 70, and two monopole antenna elements 50 and 60. In the MIMO antenna 101, a radiating element 51 of the monopole antenna element 50, and a radiating element 61 of the monopole antenna element 60 have conductor portions extending parallel to one another.

The dimensions of the configuration illustrated in FIG. 18 upon characteristic measurement were set up as follows (in mm).

L11, L21: 6.5

L12, L22: 31.5

L3: 2.1

W11, W21: 1.9

The dimensions of the configuration illustrated in FIG. 19 upon characteristic measurement were set up as follows (in mm).

L31, L41: 10.95

L32, L42: 30

L4: 2.1

W31, W41: 1.9

W32, W42: 1.9

W33, W43: 1

The dimensions of the configuration illustrated in FIG. 20 upon characteristic measurement were set up as follows (in mm).

L51, L61: 22.95 (D1=1)

L51, L61: 21.95 (D1=2)

L51, L61: 20.95 (D1=3)

L51, L61: 19.95 (D1=4)

L51, L61: 18.95 (D1=5)

L51, L61: 17.95 (D1=6)

L101: 2.1

W51, W61: 1.9

W52, W62: 1.9

Note that the thickness of the ground plane 70, and the feeding/radiating elements, and the dimensions of the dielectric substrate were set up to be the same as those of Application Example 1.

Figure 21:
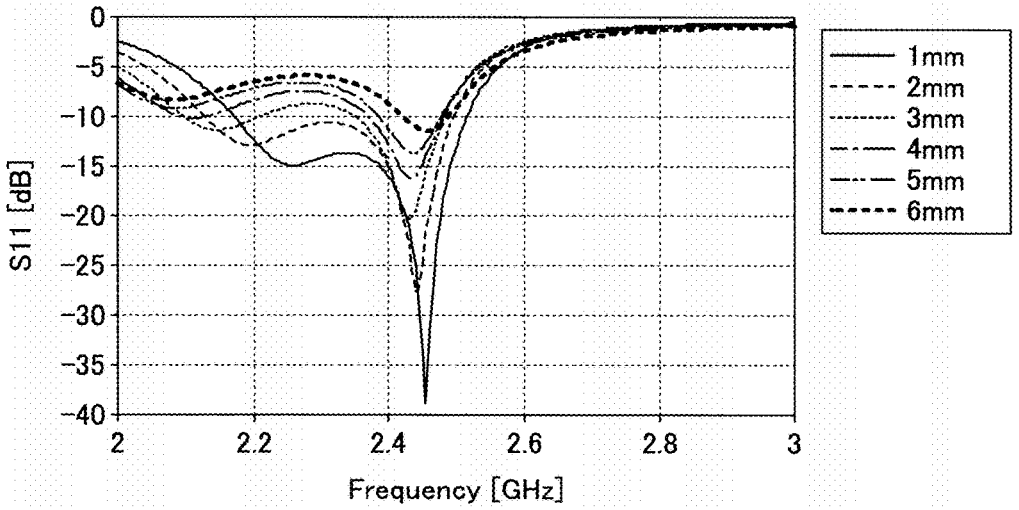
FIG. 21 is a graph showing S11 characteristics upon changing the distance D1 between the radiating element and the ground plane of the MIMO antenna including dipole antenna elements having radiating elements that are parallel.
Figure 22:
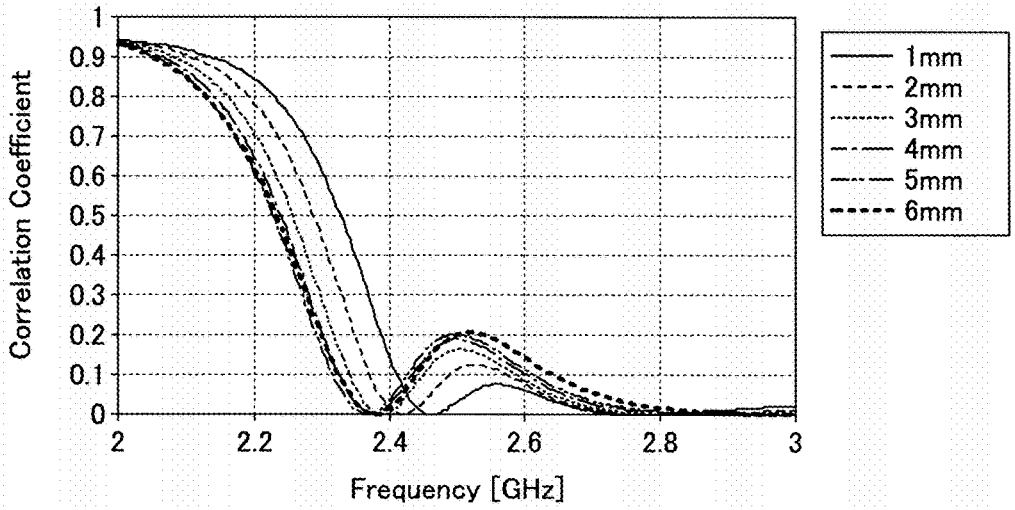
FIG. 22 is a graph showing correlation coefficient characteristics upon changing the distance D1 of the MIMO antenna including dipole antenna elements having radiating elements that are parallel.
Figure 23:
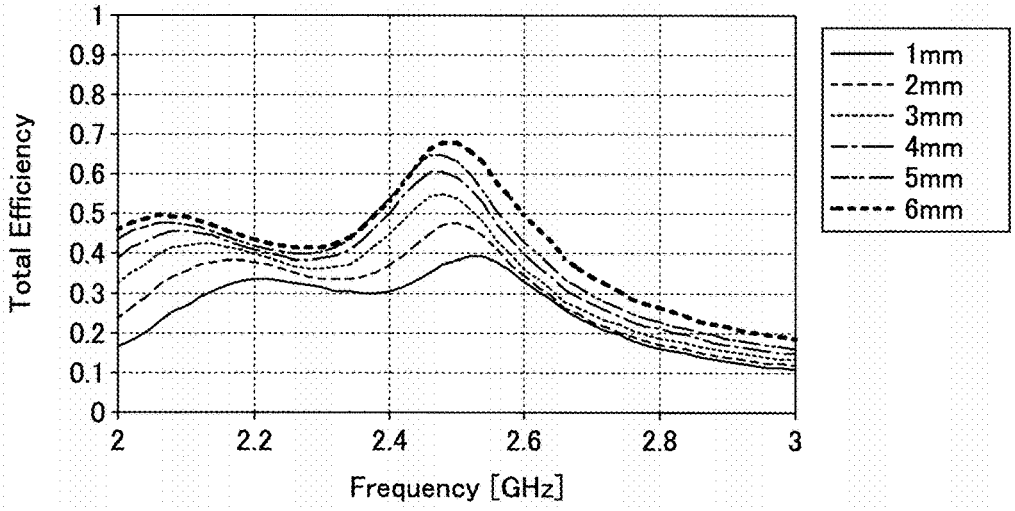
FIG. 23 is a graph showing total efficiency characteristics upon changing the distance D1 of the MIMO antenna including dipole antenna elements having radiating elements that are parallel.
Figure 24:
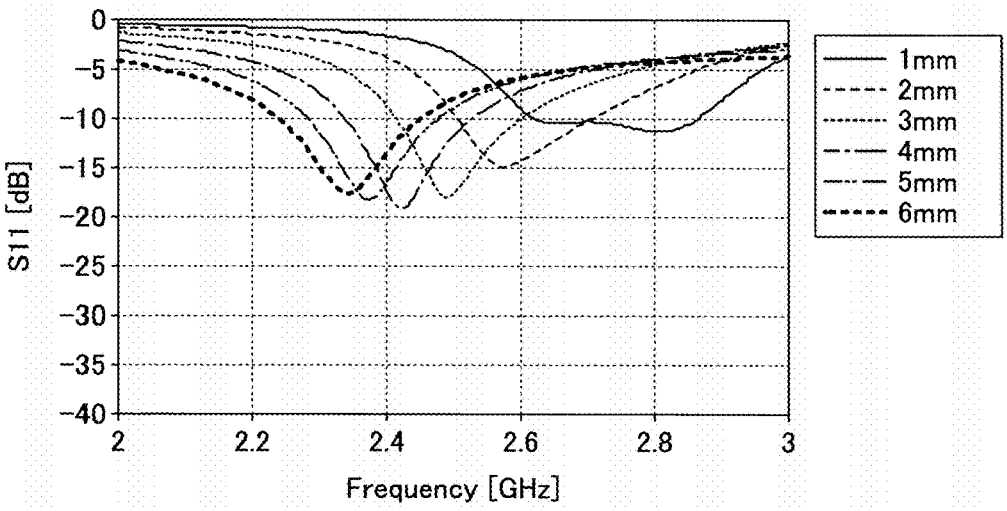
FIG. 24 is a graph showing S11 characteristics upon changing the distance D1 of the MIMO antenna including dipole antenna elements having radiating elements that are parallel and are coupled by electromagnetic field coupling.
Figure 25:
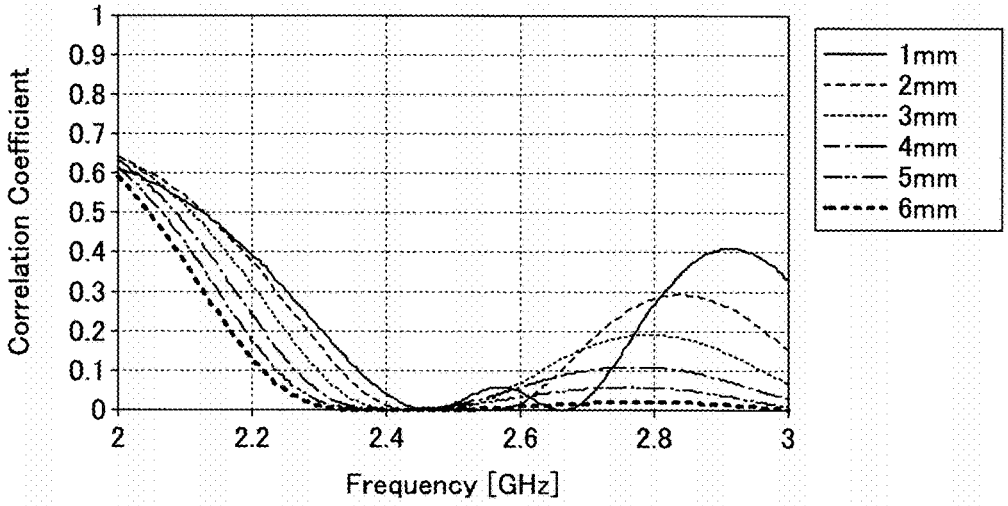
FIG. 25 is a graph showing correlation coefficient characteristics upon changing the distance D1 of the MIMO antenna including dipole antenna elements having radiating elements that are parallel and are coupled by electromagnetic field coupling.
Figure 26:
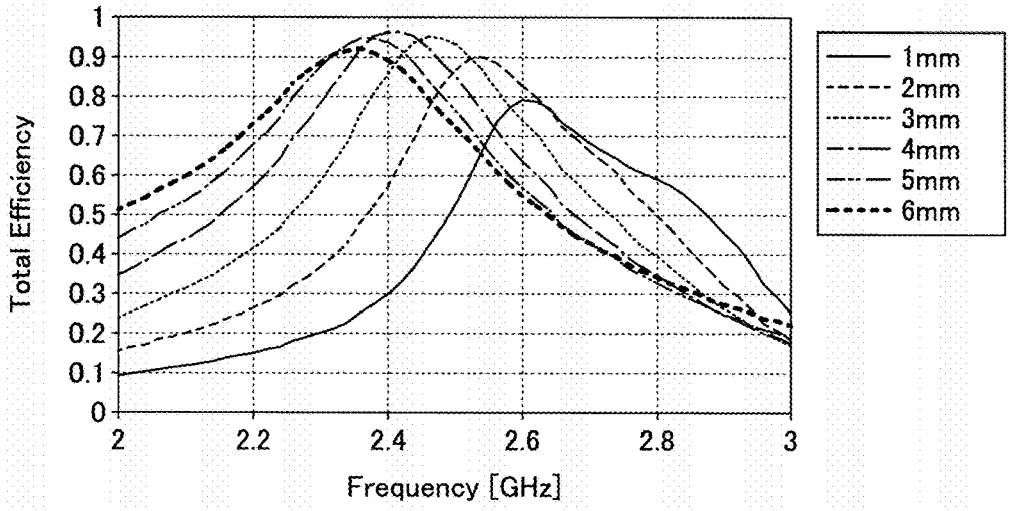
FIG. 26 is a graph showing total efficiency characteristics upon changing the distance D1 of the MIMO antenna including dipole antenna elements having radiating elements that are parallel and are coupled by electromagnetic field coupling.
Figure 27:
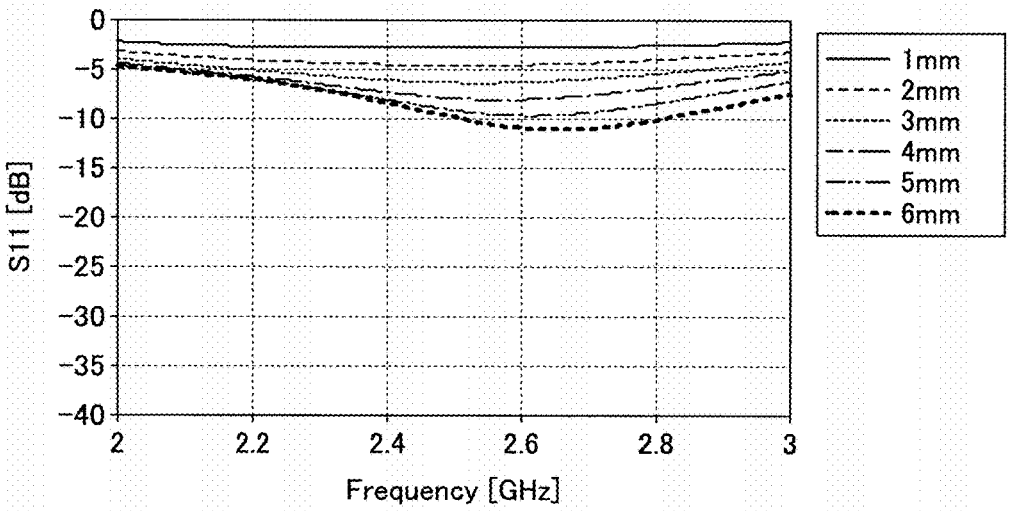
FIG. 27 is a graph showing S11 characteristics upon changing the distance D1 of the MIMO antenna including monopole antenna elements having radiating elements that are parallel.
Figure 28:
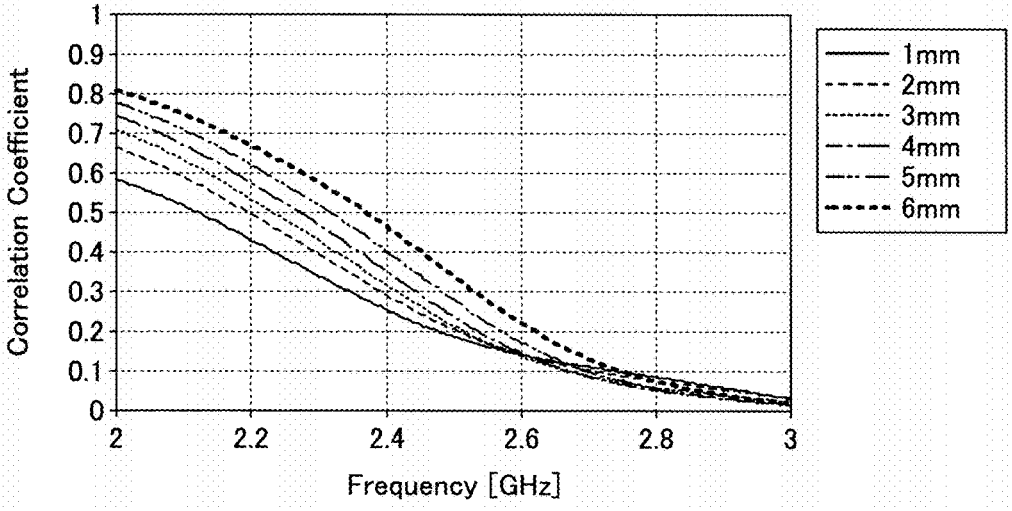
FIG. 28 is a graph showing correlation coefficient characteristics upon changing the distance D1 of the MIMO antenna including monopole antenna elements having radiating elements that are parallel.
Figure 29:
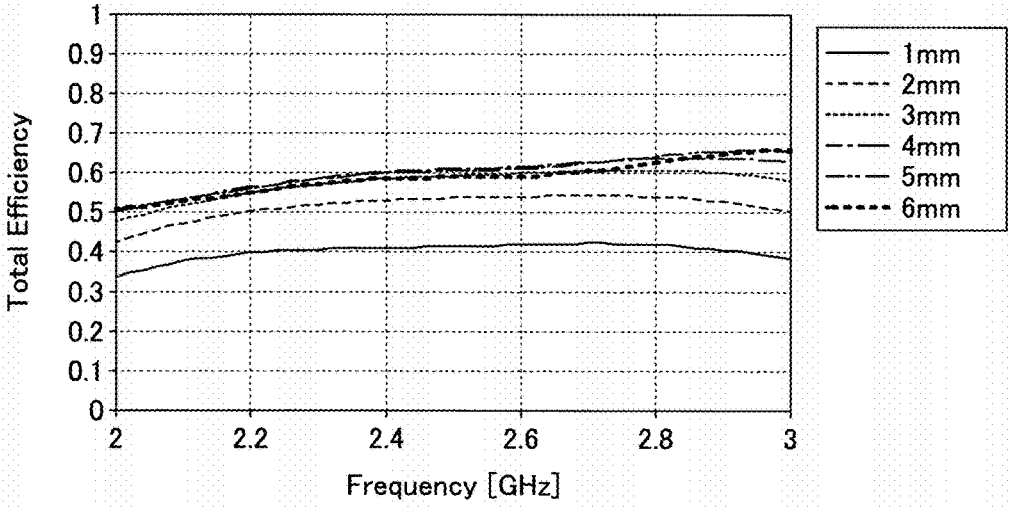
FIG. 29 is a graph showing total efficiency characteristics upon changing the distance D1 of the MIMO antenna including monopole antenna elements having radiating elements that are parallel.

FIG. 21 is a graph showing S11 characteristics of the MIMO antenna 3 using dipole antenna elements. FIG. 22 is a graph showing correlation coefficient characteristics of the MIMO antenna 3. FIG. 23 is a graph showing total efficiency characteristics of the MIMO antenna 3. FIG. 24 is a graph showing S11 characteristics of the MIMO antenna 4 using dipole antenna elements that are fed through electromagnetic field coupling. FIG. 25 is a graph showing correlation coefficient characteristics of the MIMO antenna 4. FIG. 26 is a graph showing total efficiency characteristics of the MIMO antenna 4. FIG. 27 is a graph showing S11 characteristics of the MIMO antenna 101 using monopole antenna elements. FIG. 28 is a graph showing correlation coefficient characteristics of the MIMO antenna 101. FIG. 29 is a graph showing total efficiency characteristics of the MIMO antenna 101.

TABLE 4

| Frequency at which minimum S11 is obtained [GHz] | 1 mm | 2 mm | 3 mm | 4 mm | 5 mm | 6 mm |
|---|---|---|---|---|---|---|
| MIMO Antenna 101 | 2.51 | 2.51 | 2.54 | 2.57 | 2.61 | 2.66 |
| MIMO Antenna 3 | 2.45 | 2.44 | 2.44 | 2.44 | 2.44 | 2.46 |
| MIMO Antenna 4 | 2.65 | 2.58 | 2.49 | 2.42 | 2.38 | 2.34 |

Table 4 indicates the frequencies at which the minimum S11 was obtained (i.e., resonant frequencies at which best matching was obtained) in the MIMO antennas 3, 4, and 101 according to the graphs showing the S11 characteristics of the MIMO antennas 3, 4, and 101 (FIGS. 21, 24, and 27).

TABLE 5

| Correlation Coefficient | 1 mm | 2 mm | 3 mm | 4 mm | 5 mm | 6 mm |
|---|---|---|---|---|---|---|
| MIMO Antenna 101 | 0.18 | 0.20 | 0.18 | 0.17 | 0.17 | 0.17 |
| MIMO Antenna 3 | 0.0020 | 0.015 | 0.056 | 0.10 | 0.12 | 0.14 |
| MIMO Antenna 4 | 0.0030 | 0.0030 | 0.0020 | 0.0015 | 0.0015 | 0.0014 |

Table 5 indicates the correlation coefficients at the frequencies at which the minimum S11 was obtained in the MIMO antennas 3, 4, and 101 according to the graphs showing the correlation coefficient characteristics of the MIMO antennas 3, 4, and 101 (FIGS. 22, 25, and 28). It can be appreciated from Table 5 that the correlation coefficients of the MIMO antennas 3 and 4 using dipole antenna elements were lower than the correlation coefficients of the MIMO antenna 101 using monopole antenna elements.

TABLE 6

| Total Efficiency | 1 mm | 2 mm | 3 mm | 4 mm | 5 mm | 6 mm |
|---|---|---|---|---|---|---|
| MIMO Antenna 101 | 0.41 | 0.53 | 0.60 | 0.61 | 0.61 | 0.60 |
| MIMO Antenna 3 | 0.39 | 0.42 | 0.51 | 0.58 | 0.61 | 0.62 |
| MIMO Antenna 4 | 0.77 | 0.86 | 0.95 | 0.97 | 0.94 | 0.92 |

Table 6 indicates the total efficiencies of the MIMO antennas 3, 4, and 101 at the frequencies at which the minimum S11 was obtained according to the graphs showing the total efficiency characteristics of the MIMO antennas 3, 4, and 101 (FIGS. 23, 26, and 29). It can be appreciated from Table 6 that the total efficiencies of the MIMO antennas 3 and 4 using dipole antenna elements were higher than the total efficiencies of the MIMO antenna 101 using monopole antenna elements. Note that in FIGS. 21 through 29 and Tables 4 through 6, "1 mm," "2 mm," "3 mm," "4 mm," "5 mm," and "6 mm" represent the distance D1, and when converted into the shortest distance D2, they would respectively be "3 mm," "3.4 mm," "4.1 mm," "4.9 mm," "5.7 mm," and "6.6 mm."

APPLICATION EXAMPLE 4

In the following, results of measuring the voltage standing wave ratio (VSWR) of the MIMO antenna 1 using dipole antenna elements (FIG. 1) upon changing the distance D2 between the radiating element and the ground plane, and the offset distance of the feeding portion with respect to the central portion of the radiating element are described. Note that the offset distance refers to the distance between the feeding portion 16 (or the feeding portion 26) and the central portion 90.

Note that the fundamental mode resonant frequency of the radiating elements 11 and 21 were set in the vicinity of 2.4 GHz, and the dimensions of the configuration illustrated in FIG. 1 upon VSWR measurement were arranged to be the same as those of Application Example 1.

TABLE 7

| VSWR | | Distance from Ground | | | | | | |
|---|---|---|---|---|---|---|---|---|
| S11 [dB] < -6.0 | | 0.028 | 0.039 | 0.046 | 0.053 | 0.068 | 0.083 | 0.099 |
| Feeding Position | 0 | -3.01 | -4.44 | -5.25 | -6.2 | -8.5 | -8.19 | -9.65 |
| | 0.08 | -3.1 | -4.7 | -5.52 | -6.5 | -9 | -8.38 | -9.85 |
| | 0.11 | | | -5.75 | | | | |
| | 0.13 | | | -6.06 | | | | |
| | 0.16 | -3.7 | -5.5 | -6.48 | -7.5 | -10.7 | -8.76 | -10.1 |
| | 0.24 | -5.08 | -7.4 | -8.7 | -9.5 | -15.2 | -8.5 | -9.54 |
| | 0.32 | -8.07 | -12.2 | -13.7 | -12 | -31.61 | -6.5 | -6.97 |
| | 0.39 | -11.6 | -14.4 | -12.2 | -8 | -9.7 | -3.4 | -3.62 |

Table 7 indicates S11 values calculated from the VSWR that were measured upon changing the distance D2 and the offset distance. Note that the "Distance from Ground" in Table 7 represents a normalized value (D2/125) corresponding to the actual distance D2 normalized by the wavelength in vacuum $\lambda_0$ of the frequency 2.4 GHz ($\lambda_0$=125 mm). The "Feeding Position" in Table 7 represents a ratio of a shift amount (=offset distance) of the feeding portions 16 and 26 toward the end portions 14 and 24 from the central portion 90 with respect to the total length (=38 mm) of the radiating elements 11 and 21. When this ratio is 0, this means that the feeding portions 16 and 26 are located at the central portion 90. Also, in Table 7, S11 values that are less than −6.0 are surrounded by dotted lines. It is assumed that good matching of the dipole antenna elements can be achieved when the S11 is less than −6.0.

According to Table 7, if the radiating element is spaced apart from the ground plane such that the distance D2 is greater than 0.046 $\lambda_0$ and less than 0.053 $\lambda_0$ (e.g., D2=0.05 $\lambda_0$), the feeding portion may be located in the vicinity of the central portion of the radiating element.

Also, according to Table 7, when the distance D2 is less than or equal to 0.05 $\lambda_0$, the feeding portion is preferably offset from the central portion of the radiating element by a distance greater than or equal to ⅛ (=0.125) of the total length of the radiating element (0.11<0.125<0.13). Also, according to Table 7, when the distance D2 is less than or equal to 0.043 $\lambda_0$, the feeding portion is preferably offset from the central portion of the radiating element by a distance greater than or equal to ⅙ (=0.166) of the total length of the radiating element (0.16<0.166<0.24). Also, according to Table 7, when the distance D2 is less than or equal to 0.034 $\lambda_0$, the feeding portion is preferably offset from the central portion of the radiating element by a distance greater than or equal to ¼ (=0.25) of the total length of the radiating element (0.24<0.25<0.32).

Although the MIMO antenna according to the present invention has been described above with respect to certain illustrative embodiments, the present invention is not limited to the above embodiments. Note that various modifications and improvements may be made within the scope of the present invention, for example, by combining or substituting the above embodiments with a part or all of other exemplary embodiments.

For example, the MIMO antenna is not limited to having two dipole antenna elements but may have three or more dipole antenna elements.

Also, the plurality of dipole antenna elements is not limited to the configurations illustrated in the drawings. For example, the dipole antenna element 10 of FIG. 1 may have a conductor portion that is directly connected to the radiating element 11 or indirectly connected to the radiating element 11 via a connecting conductor, or the dipole antenna element 10 may have a conductor portion that is coupled to the radiating element 11 through high-frequency coupling (e.g., capacitive coupling). Note that the above configurations may be similarly applied to the other dipole antenna elements.

Also, the dipole antenna element is not limited to those including a linear conductor portion extending linearly, but may also include a curved conductor portion. For example, the dipole antenna element may include an L-shaped conductor portion, a meander-shaped conductor portion, or a conductor portion that branches out from a branch point.

Also, the feeding element may include a stub, or a matching circuit, for example. In this way, an area of a substrate occupied by the feeding element may be reduced.

Also, the transmission line to which the feeding portion is connected is not limited to a microstrip line. For example, the transmission line may be a strip line, or a coplanar waveguide having a ground plane (coplanar waveguide with a ground plane arranged on a surface on the opposite side of a conductor face). The feeding element and the feeding points may be connected via these different types of transmission lines, for example.

What is claimed is:

1. A MIMO antenna, comprising:

a ground plane; and a plurality of dipole antenna elements positioned in the vicinity of the ground plane such that each of the dipole antenna elements is configured to resonate through electromagnetic field coupling excluding electrostatic capacitive coupling and electromagnetic induction coupling, wherein each of the dipole antenna elements includes a radiating element comprising a conductor portion extending along an outer edge portion of the ground plane, a feeding portion that feeds the radiating element, and a feeding element having Le37 of less than or equal to (3/8)λ and spaced apart from the radiating element by a coupling distance such that the feeding element is configured to resonate at and couple with the radiating element in a near field through the electromagnetic field coupling excluding electrostatic capacitive coupling and electromagnetic induction coupling and feeds the radiating element via the feeding portion through non-contact feeding, where Le37 denotes an electrical length that imparts a fundamental mode of resonance to the feeding element and λ denotes a wavelength on the feeding element or the radiating element at a resonant frequency of the fundamental mode of the radiating element.

2. The MIMO antenna according to claim 1, wherein each of the dipole antenna elements is formed such that the feeding portion is positioned at a region other than a central portion of the radiating element.

3. The MIMO antenna according to claim 2, wherein the plurality of dipole antenna elements is formed such that the feeding portion is positioned at a region shifted from the central portion of the radiating element for each of the dipole antennas in directions approaching each other.

4. The MIMO antenna according to claim 2, wherein each of the dipole antenna elements is formed such that the feeding portion is positioned at a region spaced apart from the central portion of the radiating element by a distance greater than or equal to 1/8 of a total length of the radiating element.

5. The MIMO antenna according to claim 1, wherein each of the dipole antenna elements is formed such that a distance between the radiating element and the ground plane is less than or equal to $0.05\lambda_0$, where $\lambda_0$ denotes a wavelength in vacuum at a design frequency of the radiating element.

6. The MINO antenna according to claim 1, wherein each of the dipole antenna elements is formed such that Le31 is greater than or equal to (3/8)λ and less than or equal to (5/8)λ, where Le31 denotes an electrical length that imparts a fundamental mode of resonance to the radiating element.

7. The MIMO antenna according to claim 1, wherein each of the dipole antenna elements is formed such that a shortest distance between the feeding element and the radiating element is less than or equal to $0.2\lambda_0$, where $\lambda_0$ denotes a wavelength in vacuum at a resonant frequency of a fundamental mode of the radiating element.

8. The MIMO antenna according to claim 1, wherein each of the dipole antenna elements is formed such that the feeding portion is positioned at a region other than a portion having a lowest impedance at the resonant frequency of the fundamental mode of the radiating element.

9. The MIMO antenna according to claim 1, wherein each of the dipole antenna elements is formed such that the feeding portion is positioned at a region spaced apart from a portion having a lowest impedance at the resonant frequency of the fundamental mode of the radiating element by a distance greater than or equal to 1/8 of a total length of the radiating element.

10. The MIMO antenna according to claim 1, wherein each of the dipole antenna elements is formed such that a distance over which the feeding element and the radiating element run parallel to each other at a shortest distance is less than or equal to 3/8 of a length of the radiating element.

11. The MIMO antenna according to claim 1, wherein the plurality of dipole antenna elements is configured such that the conductor portion of the radiating element is extending in an orthogonal direction.

12. The MIMO antenna according to claim 11, wherein each of the dipole antenna elements is formed such that the feeding portion is positioned away from a central portion of the radiating element toward a corner portion of the ground plane.

13. A wireless device comprising the MIMO antenna according to claim 1.

14. The MIMO antenna according to claim 1, wherein the plurality of dipole antenna elements is formed such that the conductor portion of the radiating element is extending parallel to one another.

15. The MIMO antenna according to claim 1, wherein the radiating element has a resonant frequency that is different from a resonant frequency of the feeding element.

16. A MIMO antenna, comprising:

a ground plane; and a plurality of dipole antenna elements positioned in the vicinity of the ground plane such that each of the dipole antenna elements is configured to resonate through electromagnetic field coupling excluding electrostatic capacitive coupling and electromagnetic induction coupling, wherein the ground plane comprises at least one corner portion, a first outer edge portion extending from the corner portion, a second outer edge portion extending from the corner portion in a direction orthogonal to an extending direction of the first outer edge portion, and the plurality of dipole antenna elements includes a first dipole antenna element and a second dipole antenna element, the first dipole antenna element comprises a first radiating element comprising a conductor portion extending along the first outer edge portion, a first feeding portion that feeds the first radiating element, and a first feeding element having Le37 of less than or equal to (3/8)λ and spaced apart from the first radiating element by a coupling distance in a near field such that the first feeding element is configured to resonate and couple with the first radiating element through the electromagnetic field coupling excluding electrostatic capacitive coupling and electromagnetic induction coupling and feeds the first radiating element via the first feeding portion through non-contact feeding, where Le37 denotes an electrical length that imparts a fundamental mode of resonance to the feeding element and λ denotes a wavelength on the feeding element or the radiating element at a resonant frequency of the fundamental mode of the radiating element, and the second dipole antenna element comprises a second radiating element comprising a conductor portion extending along the second outer edge portion, a second feeding portion that feeds the second radiating element, and a second feeding element having Le37 of less than or equal to (3/8)λ and spaced apart from the second radiating element by a coupling distance in a near field such that the second feeding element is configured to resonate and couple with the second radiating element through the electromagnetic field coupling excluding electrostatic capacitive coupling and electromagnetic induction coupling and feeds the second radiating element via the second feeding portion through non-contact feeding, where Le37 denotes an electrical length that imparts a fundamental mode of resonance to the feeding element and λ denotes a wavelength on the feeding element or the radiating element at a resonant frequency of the fundamental mode of the radiating element.

17. The MIMO antenna according to claim 16, wherein the first and second dipole antenna elements are formed such that each of the first and second feeding portions is positioned at a region other than a central portion of the respective one of the first and second radiating elements.

18. The MIMO antenna according to claim 17, wherein the plurality of dipole antenna elements is formed such that each of the first and second feeding portions is positioned at a region shifted from the central portion of the respective one of the first and second radiating elements in directions approaching each other.

19. The MIMO antenna according to claim 17, wherein the first and second dipole antenna elements are formed such that each of the first and second feeding portions is positioned at a region spaced apart from the central portion of the respective one of the first and second radiating element by a distance greater than or equal to 1/8 of a total length of the respective one of the first and second radiating element.

20. The MIMO antenna according to claim 16, wherein the first and second dipole antenna elements are formed such that the first and second radiating elements and the ground plane do not contact each other such that a distance between the first and second radiating elements and the ground plane is less than or equal to $0.05\lambda_0$, where $\lambda_0$ denotes a wavelength in vacuum at a design frequency of the radiating element.

* * * * *